US008752896B2

(12) United States Patent
Takeuchi et al.

(10) Patent No.: US 8,752,896 B2
(45) Date of Patent: Jun. 17, 2014

(54) ROCKING CHAIR

(75) Inventors: Hiroshi Takeuchi, Osaka (JP); Shinji Inoue, Osaka (JP); Minoru Hashimoto, Osaka (JP); Jun Tatsuno, Osaka (JP)

(73) Assignee: Itoki Corporation, Osaka-shi, Osaka (JP)

( * ) Notice: Subject to any disclaimer, the term of this patent is extended or adjusted under 35 U.S.C. 154(b) by 226 days.

(21) Appl. No.: 13/503,943

(22) PCT Filed: Nov. 30, 2009

(86) PCT No.: PCT/JP2009/070128
§ 371 (c)(1),
(2), (4) Date: Apr. 25, 2012

(87) PCT Pub. No.: WO2011/052099
PCT Pub. Date: May 5, 2011

(65) Prior Publication Data

US 2012/0205952 A1 Aug. 16, 2012

(30) Foreign Application Priority Data

Oct. 26, 2009 (JP) ..... 2009-245006

(51) Int. Cl.
*A47C 1/024* (2006.01)

(52) U.S. Cl.
USPC ..... 297/300.2; 297/300.1; 297/302.1; 297/341

(58) Field of Classification Search
USPC ..... 297/284.3, 300.1, 300.2, 300.5, 302.1, 297/302.4, 341, 342, 343
See application file for complete search history.

(56) References Cited

U.S. PATENT DOCUMENTS

| | | | | |
|---|---|---|---|---|
| 4,167,288 | A * | 9/1979 | Kiang | 297/378.1 |
| 4,761,033 | A * | 8/1988 | Lanuzzi et al. | 297/300.3 |
| 4,842,333 | A | 6/1989 | Meiller | |
| 5,333,368 | A * | 8/1994 | Kriener et al. | 297/302.1 |
| 5,868,467 | A | 2/1999 | Moll | |
| 6,460,928 | B2 * | 10/2002 | Knoblock et al. | 297/300.2 |
| 7,270,371 | B2 * | 9/2007 | Adragna et al. | 297/14 |
| 2002/0171277 | A1 * | 11/2002 | Bock | 297/300.2 |
| 2004/0004380 | A1 | 1/2004 | Horiki et al. | |
| 2004/0135413 | A1 * | 7/2004 | Zund | 297/342 |

(Continued)

FOREIGN PATENT DOCUMENTS

| | | |
|---|---|---|
| CA | 1286589 | 7/1991 |
| CN | 1195501 A | 10/1998 |

(Continued)

*Primary Examiner* — Philip Gabler
(74) *Attorney, Agent, or Firm* — Drinker Biddle & Reath LLP

(57) ABSTRACT

Provided is a chair suited to the use of a keyboard or mouse, the chair has a seat 3 and a rocking backrest 4. The seat 3 comprises a first section 3*a*, 12*a* and a second section 3*b*, 12*b*. The first section 3*a* of the seat 3 is affixed to a seat-mounting shell 11 is attached to a base 9, via a seat-mounting fixture, so as to be slide forwards and backwards. The backrest 4 has a back cover 14, a back panel 15 and a cushion move downwards while rotating in a seesaw fashion during rocking. The front end of the back cover 14 is connected to the seat-mounting fixture 10 by means of a connecting pin 25. When the chair rocks, the seat 3 moves forwards as a whole while the second section 3*b* tilts backward.

16 Claims, 27 Drawing Sheets

(56) References Cited

U.S. PATENT DOCUMENTS

| | | | | |
|---|---|---|---|---|
| 2004/0195881 | A1* | 10/2004 | Wells | 297/262.1 |
| 2004/0245840 | A1 | 12/2004 | Tubergen et al. | |
| 2008/0217977 | A1 | 9/2008 | Aldrich et al. | |
| 2009/0152921 | A1 | 6/2009 | Johnson et al. | |
| 2011/0241399 | A1 | 10/2011 | Castro, Jr. et al. | |
| 2011/0241405 | A1 | 10/2011 | Slagh | |
| 2011/0248537 | A1 | 10/2011 | Aldrich et al. | |
| 2011/0285192 | A1 | 11/2011 | Holt et al. | |
| 2011/0298261 | A1 | 12/2011 | Holt et al. | |

FOREIGN PATENT DOCUMENTS

| | | | |
|---|---|---|---|
| CN | 1713841 | A | 12/2005 |
| DE | 37 24 582 | A1 | 2/1989 |
| DE | 42 10 282 | C1 | 4/1993 |
| EP | 0 069 410 | A1 | 1/1983 |
| EP | 0 105 955 | A1 | 4/1984 |
| EP | 0919161 | A2 | 6/1999 |
| EP | 2 243 398 | A1 | 10/2010 |
| JP | A-H07-155233 | | 6/1995 |
| JP | H11/018867 | A | 1/1999 |
| JP | 11-113668 | A | 4/1999 |
| JP | 2000-236977 | | 9/2000 |
| JP | 2004-33444 | | 2/2004 |
| JP | A-2004-248841 | | 9/2004 |
| JP | 2006-526484 | | 11/2006 |
| JP | 2008-12227 | | 1/2008 |
| JP | A-2008-012186 | | 1/2008 |
| JP | 2008-212622 | | 9/2008 |
| JP | 2009-165659 | | 7/2009 |
| WO | WO 00/01279 | A1 | 1/2000 |
| WO | WO 2008/094865 | | 8/2008 |

* cited by examiner

ROCKING CHAIR

TECHNICAL FIELD

The present invention relates to a rocking chair whose backrest tilts backwards against spring means (resilient means) and, more particularly, to a chair whose seat moves forwards concurrently with backward tilting action of the backrest.

BACKGROUND ART

Various contrivances are made to a rocking chair whose backrest tilts backwards in order to enhance amenity and a degree of satisfaction acquired in a rocking state. Patent Document 1 discloses, as one of such contrivances, a chair whose backrest lowers while tilting backwards and whose seat moves forwards while wholly tilting backwards when a seated person reclines against the backrest.

Forward movement of the seat resultant from rocking action contributes to yielding an advantage of making it easy to perform body stretching even at a small backward tilt angle of the backrest. For this reason, when compared with a case where only the backrest tilts backwards, a resting function per unit backward tilt angle can be enhanced (namely, a high comfortable state can be assured even when the chair is rocked through a small angle).

In Patent Document 1, the backrest tilts backwards while its lower end is moving forwards. In this tilted mode, an upper body of a seated person does not greatly bend backwards when rocking the chair. Accordingly, even when the seated person rocks the chair during operation of a keyboard or a mouse on a desk while viewing a monitor (a display) as in the case of; for instance, operation of a personal computer, the body is not much pulled away from the desk. Consequently, the user can continually perform working in a comfortable state while rocking the chair.

In Patent Document 1, a rear end of the seat becomes lower in a state of forward movement while the height of a front end of the seat remains unchanged, whereby the seat remains backwardly tilted as a whole. As a result of the seat tilting backwards, even when the backrest is lowered, a distance between a lower end of the backrest and a rear end of the seat substantially remains unchanged, so that no relative slippage exists between the backrest and the back of the seated person. As a consequence, it is understood that occurrence of a "curling-up-of-a-shirt" phenomenon in which vertical slippage occurs between a shirt of a seated person and the back thereof can be prevented during rocking.

Patent Document 2 also discloses a chair similar to that described in connection with Patent Document 1. A seat is first described in connection with Patent Document 2. A seat base 102 is fitted to a base (a chassis body) 30, which is fastened to an upper end of a leg (a gas cylinder), so as to be slidable in backward and forward. A seat 18 is attached to the seat base 102. A joint member (a channel member) 136 standing upright behind a backrest 20 is fastened to a rear end of the sheet base 102. A lower portion of the backrest 20 is joined to the joint member 136 by way of a bracket 130 so as to be vertically slidable.

Moreover, a back support bar 104 standing upright behind the backrest 20 and the joint member 136 is fastened to the base 30. Thus, an upper end of the back support bar 104 and a back face of the backrest 20 are slidably joined together. According to Patent Document 2, when a seated person leans against the backrest 20, the backrest 20 in its entirety descends while remaining tilted around the upper end of the back support bar 104. Moreover, the seat 18 moves forwards in synchronism with descending action of the backrest 20.

A plurality of chairs whose seats move backwards when used as rocking chairs have already been put into practice. There are large numbers of documents, including Patent Document 3, in relation to the chairs. In many chairs, a backrest has a back shell (a back panel) made of resin. Disclosed in Patent Document 3 is, as means for attaching the back shell to a backrest frame positioned behind the back shell, to join a lower portion of the backrest to the backrest frame by means of right and left horizontal pins and to join an upper end of the backrest to a back frame in a slidable manner.

RELATED ART DOCUMENTS

Patent Documents

Patent Document 1: JP-A-2000-236977
Patent Document 2: US2009/0152921A1
Patent Document 3: JP-A-2009-165659

DISCLOSURE OF THE INVENTION

Problems that the Invention is to Solve

Work for manipulating a mouse, as in the case of PC and CAD operations, considerably accounts for today's office work. When a person manipulates a mouse while sitting on a chair, the person often manipulates the mouse while rocking the chair.

In this case, the person manipulates the mouse while viewing a monitor (a display) on a desk. However, during rocking action, the person must keep his/her head upright in order to view the monitor from the front while his/her body remains tilted backwards. There arises a problem of a neck being vulnerable to a strain because of such a postural misalignment between the body and the head. The postural misalignment between the body and the head occurred during rocking action becomes more noticeable with an increase in backward tilt angle of the backrest.

Moreover, a potential demand for doing work on a desk while assuming a rocking posture, can be said to be high. However, since an ordinary chair makes the upper body of the seated person greatly bend backwards while rocking, shoulders of the seated person are much pulled away from the desk by means of rocking action, which consequently raises a problem of making the person difficult to perform keyboard operation or writing work. These problems can be said to be improved to a certain extent by means of synchronously actuating the backrest and the seat as described in connection with Patent Documents 1 and 2.

However, according to Patent Document 1, the seat merely moves backwards in its entirety during rocking action. Hence, there is yielded the same result as that yielded when the backward tilt angle of the backrest decreases by the amount corresponding to an angle through which the seat tilts backwards. Consequently, it is said that an effect of enhancing a comfortable characteristic cannot be sufficiently accomplished.

On the other hand, in Patent Document 2, the backrest 20 descends during rocking action, but the seat merely moves forwards. Accordingly, the chair disclosed by Patent Document 2 lacks a function of embracing the body of the seated person by means of the backrest and the seat during rocking action. Therefore, the chair can be said to exhibit a high potential of insufficiently assuring a comfortable characteristic as in the case of the chair disclosed in Patent Document 1. Moreover, according to Patent Document 2, a height between the rear end of the seat and the rear end of the backrest changes during rocking action. Therefore, the chair disclosed in Patent Document 2 may cause the "curling-up-of-a-shirt" phenomenon.

Further, when the seat moves forward during rocking, body stretching becomes easy. Therefore, a breech tends to be pushed forwards while pivoted around the backrest. As a consequence, the configuration in which the entirety of the seat merely moves backwards during rocking action, such as that described in connection with Patent Document 1, is expected to make the seated person feel as if his/her breech (and femoral areas) slides forwards with respect to the seat. For this reason, there is a possibility that a fitting characteristic achieved during rocking action will not always be suffice. The same also holds true for Patent Document 2.

The related-art techniques can be said to be susceptible to structural improvements. Specifically, in relation to Patent Document 1, Patent Document 1 discloses a combination of the slide mechanism and the link mechanism in order to cause simultaneous actions of the backrest and the seat. This causes a problem of an overall structure of the chair being complicate. On the other hand, in Patent Document 2, simultaneous actions of the backrest and the seat are implemented by utilization of the simple slide mechanism; hence, the structure of the chair can be simplified. However, since active parts remain exposed, the parts uglify the chair. There is also a risk of fingers of the seated person or a material (e.g., a garment) being caught in the slide mechanism.

The invention of the present patent application has been conceived to improve the present situations. The present patent application discloses various improvements, and providing a rocking chair including the improvements should also be taken in as an objective of the present patent application.

Means for Solving the Problem

A rocking chair of the present invention comprises a seat on which a person is to sit, a backrest against which a seated person leans, and a base section that supports the seat and the backrest and is basically configured in such a way that, when a seated person leans against the backrest, the seat moves forwards and the backrest tilts backwards while an upper end of the backrest moves backwards and while a lower end of the backrest moves forwards.

In a first invention, the seat has a first section including a front end of the seat and a second section including a rear end; the second section can tilt backwards with respect to the first section when viewed sideways; the backrest is supported by backrest guide means so as to descend while tilting backwards; the second section of the seat and the backrest are joined together in such a way that the second section of the seat tilts backwards when the backrest moves downward; and an entirety of the backrest descends while tilting backwards when the seated person leans against the backrest, so that the second section tilts backwards while the entirety of the seat is moving forward.

The first invention makes up a broader concept and can be developed in various ways. Examples of development of the first invention are second to ninth inventions. Of the inventions, the second invention is an embodiment of the first invention. Specifically, a second invention is based on the first invention, wherein the backrest includes a back panel and a cushion material stretched over a front surface of the back panel; the backrest guide means has back support that are affixed to the base section and that stand up behind the back panel; upper ends of the back support are situated at a height between an upper end and a lower end of the back panel; and a guide section that supports the backrest while tilting backwards and descending is provided at upper ends of the back support.

A third invention is based on the second invention, wherein the backrest has a back cover situated behind the back panel; the back cover is joined to the back support so as to tilt backwards while descending; the back panel is attached to the back cover in a state in which the back panel can become deformed under body pressure of the seated person; and the back cover and the second section of the seat are joined so as to move in conjunction with each other.

A fourth invention is based on the third invention, wherein the back support are arranged at a horizontally intermediate point on the back rest; a long groove into which the back support are to fit and that has a downwardly-oriented opening is opened at a horizontally intermediate position on the back cover, and cover means for covering the guide section is provided on the back cover and the back support regardless of back tilting of the backrest.

A fifth invention is based on the fourth invention, wherein the back support are configured of metal; a horizontally long guide pin is provided at the upper ends of the back support as an element of the backrest guide means; a vertically long guide groove into which the guide pin slidably fits is provided on an inner side surface of the long groove of the back cover as an element of the backrest guide means; a support cover for closing the long groove of the back cover is attached to the back support; and the backrest guide means is covered from behind without regard to backward tilting of the backrest as a result of an upper end of the support cover being disposed in the back cover.

A sixth invention is based on the third to fifth inventions, wherein the first section of the seat is attached to a seat-mounting shell disposed below the first section; the seat-mounting shell is attached to the base section so as to be slidable in a front-back direction; the back cover has a front facing section that extends below the second section of the seat; the second section of the seat and the front facing section of the back cover are joined so as to be relatively movable; and a rear edge of the seat-mounting shell and a front edge of the front facing section of the back cover overlap each other in such a way that a finger of a person cannot be inserted into spacing therebetween.

A seventh invention is based on the second through fifth inventions, wherein the backrest is joined to the back support so as to descend while tilting backwards around a substantially intermediate point on the backrest in its vertical direction or a height close to the intermediate point.

An eighth invention is based on the first through fifth inventions, wherein the seat has a seat panel made of resin and a cushion material stretched over an upper surface of the seat panel; and the first section and the second section are formed by making a hinge in the seat panel, to thus make the seat panel bendable, or by separating the seat panel into a front section and a back section and joining the front section to the back section in a bendable manner.

A ninth invention is based on the first or second invention, wherein the first section of the seat is attached to a first intermediate fixture joined to the base section so as to be movable back and forth; the second section of the seat is attached to a second intermediate fixture joined to the first intermediate fixture so as to be tiltable in a backward; and the backrest is attached to the back support affixed to the second fixture.

Advantages of the Invention (1) Advantages of the Present Invention (the First Invention)

In the invention of the present patent application, the second section of the seat and the backrest are joined together. Hence, during rocking action, the second section tilts backwards while the entirety of the seat is moving forward in synchronism with downward movement and backward titling of the backrest. As a result of the second section of the seat tilting backwards, a breech of the seated person tends to sag, thereby assuring a high fitting characteristic. As a result of the second section of the seat tilting backwards, the tilt angle of the backrest can be maximized while broadening of spacing between the rear end of the seat and the lower end of the backrest and occurrence of a so-called curling-up-of-a-shirt phenomenon are prevented or suppressed. Hence, when compared with a case where the entirety of the seat tilts backwards or when the seat moves merely forwards, amenity achieved during rocking action can be enhanced (a feeling of an upthrust of a femoral area caused by a front end of the seat during rocking action can also be prevented).

The backrest tilts around a position between an upper end and a lower end of the backrest. An upper body of the seated person does not much move backward during rocking action. Hence, the seated person can easily view a monitor on a desk in a rocking state and also can operate a keyboard and a mouse on the desk while assuming a rocking position.

Accordingly, the chair of the present invention can be said to be suitable for current office work. In addition, the second section (a back section) of the seat tilts backwards during rocking action. Since the chair exhibits superior body stability and fitting in a rocking state, the seated person can perform desk work even in a rocking state; namely, while sitting deeply in the chair. This is one of major characteristics of the invention of the present patent application.

Since the backrest involves small amounts of backward movement even when tilting backwards, a risk of the chair in a rocking state lying in a way of the other person who passes behind the chair can be considerably lessened. Since the upper body of the seated parson does not much bend backwards during rocking action, large force of an abdominal muscle is not required when the body returns to a non-rocking state. Therefore, the chair is suitable for women who are generally inferior to men in terms of the abdominal muscle.

Further, women show a high tendency toward avoiding a rocking posture that involving a much bend of the body because of appearance. However, the invention of the present patent application enables rocking action (reclining) of the chair in an unnoticeable manner. Hence, the chair is suitable for women.

(2) Advantage Unique to the Second Invention

In the second invention, a load acting on the backrest during rocking action is supported by the back support from behind. Hence, a superior supporting stability of the backrest is exhibited, and high practical utility is achieved.

(3) Advantage Unique to the Third Invention

In the third invention, the back panel becomes deformed under body pressure of the seated person. Hence, a cushioning characteristic achieved during rocking action can be enhanced. Since the back cover acts as a strength member for the back rest, a concern about strength does not arise in spite of the backrest that can assure cushioning characteristics. Moreover, the back cover acting as a backrest strength member and the second section of the seat are joined together. Hence, the structure of the chair can be simplified while the number of components is curtailed. As mentioned above, the third invention yields many advantages.

(4) Advantages Unique to the Fourth Invention

Forms of the back support and the back cover can be variously embodied. For instance, the back support are placed at two positions along the right-left direction while separated from each other, and the back cover can also be joined to the right and left back support. However, this form may complicate the structure of the chair. On the contrary, the configuration described in connection with the fourth invention provides a simple structure in which the back support is placed at one location. Further, the guide section of the back support is covered with cover means at all times without regard to rocking action. Hence, there is no risk of a finger of a person or an article being caught by the guide section. Thus, safety can be assured.

(5) Advantages Unique to the Fifth Invention

The back support can also be formed in their entirety from resin or by means of die casting of aluminum. If the entirety of the back support is formed from resin, concerns may arise in the back support in terms of strength. On the other hand, if the back support is wholly made by die casting aluminum, cost may increase. However, as described in connection with the fifth invention, the back support are configured of metal, and the support cover made of resin is attached to the back support, thereby yielding an advantage of the ability to curtail cost while strength and aesthetic of the chair are assured.

(6) Advantages Unique to the Sixth Invention

According to the sixth invention, the front facing section of the back cover can be used also as an under cover of the second section of the seat, so that the entire structure of the chair becomes simple. Further, during rocking action, the seat-mounting shell and the back cover tilt relatively to each other while moving forward in conjunction with each other. The rear end of the seat-mounting shell and the front end of the front facing section of the back cover are held in an overlapping manner. Hence, even when the person extends his/her hand below the seat, fingers will not be caught between the rear end of the seat-mounting shell and the front end of the back cover, so that the chair is safe.

(7) Advantages Unique to the Seventh Invention

In Patent Document 2, during rocking, a joint member (a channel member) 136 is pushed forward by means of turning action of the backrest. The seat is moved forwards by means of forward movement of the joint member (the channel member) 136. Consequently, a pivot must be placed as closely as possible to the lower end of the backrest such that the lower end of the back rest moves forwards during rocking. As a result, the body tends to bend backwards during rocking, and a great spring is needed as spring means for imparting resistance to rocking action.

On the contrary, in the seventh invention of the present patent application, a tilting fulcrum (a pivot) of the backrest is situated at a high position. Hence, it is possible to prevent accurately the body from bending backwards during rocking action. Further, exertion of great moment on the backrest during rocking action is prevented, and weak spring can also be used for rocking spring means.

In many cases, in the rocking chair, initial elastic force of the rocking spring means can be adjusted. This is because the moment exerted on the backrest during rocking can be changed according to the weight of the seated person.

On the contrary, in the seventh invention, a) great moment does not occur in the backrest during rocking action. Hence, even when the weight of the seated person varies, the difference in weight does not appear as a difference in moment on the backrest. Further, b) a portion of the weight of the seated person, acts on the seat. For this reason, the weight of the seated person acts as counterforce for hindering backward tilting of the backrest during rocking action. However, the counterforce is proportional to the weight of the seated person. Because of these two reasons, appropriate counterforce is imparted to persons having different weights even when the initial elastic force of the rocking spring is not adjusted. Accordingly, a device for adjusting initial elastic force of the rocking spring is eliminated, and the structure of the chair can be simplified (providing an elastic force adjuster is not eliminated).

(8) Advantages Unique to the Eighth Invention

The first section and the second section of the seat can also be embodied as separate members. However, when the configuration of the eighth invention is adopted, the integrity of the seat panel is held by the cushioning material even when the seat panel is bended. Hence, the seat exhibits superior comfortable feeling. In this case, when the seat panel is given an integrated structure and a hinge section, means for joining the first section to the second section becomes obviated. Hence, the structure of the seat can be correspondingly simplified.

(9) Advantages Unique to the Ninth Invention

There is a case where the backrest does not always need the back cover. Further, there is also conceived a case where the back cover is made; for instance, removable, and where only a protective function is desired to be imparted to the back cover. In such a case, the backrest and the seat can be synchronized without involvement of a necessity for the back cover by adoption of the ninth invention.

BRIEF DESCRIPTION OF THE DRAWINGS

FIG. 7(A) is viewed from above.

EMBODIMENTS FOR IMPLEMENTING THE INVENTION

Figure 1:
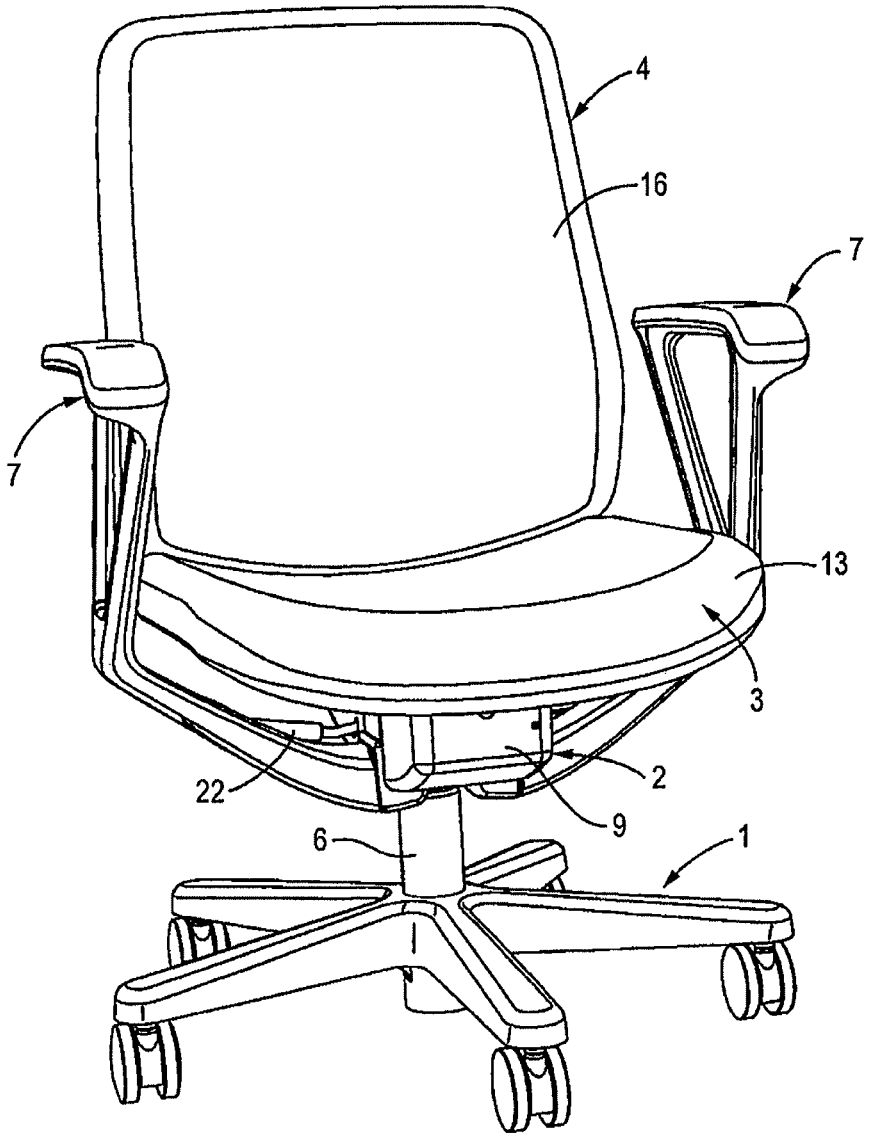
FIG. 1 is an overall perspective view of a rocking chair of a first embodiment.

Embodiments of the present invention are now described by reference to the drawings. FIGS. 1 through 16 show a first embodiment, and FIG. 17 and subsequent drawings show a second embodiment. The embodiments are sequentially described. Words "front-back," "near side," "back," "right-left," and the like, are used to designate directions in the following descriptions. The words designate orientations while a posture of a person sit in a rocking chair (hereinafter simply referred to as a "chair") is taken as a reference. "Front view" shows a state in which the chair is viewed in a direction opposing the seated person.

(1) Summary of the First Embodiment

First, a summary of the embodiment is primarily described by reference to FIGS. 1 through 4. The chair of the present embodiment is applied to a so-called swivel chair for business purpose. The chair includes, as principal elements, a leg unit 1, a base section 2, a seat 3, a backrest 4, a back support 5, and armrest devices 7.

The leg unit 1 has a leg support 6 built from a gas cylinder. The leg support 6 is fitted into a center of a leg body having a plurality of radially-expanding branched legs (five legs in general). As shown in; for instance, FIG. 4, the base section 2 has a housing-shaped base body 9 that is affixed to an upper end of the leg support 6 and opened upwardly and a seat-mounting fixture 10 that is attached to an upper end of the base body 9 so as to be slidable in a front-back direction.

The armrest devices 7 are optional parts and removably attached to the base body 9 (which will be described later).

After removal of the armrest devices 7, mount holes are opened in the base body 9. The mount holes are closed respectively by removable resin covers 9*d* (see FIG. 6, FIG. 7(B), and others).

The seat 3 has a seat panel (a seat inner shell) 12 and a seat cushion body 13 stretched over an upper surface of the seat panel. The seat cushion body 13 is covered with a surface skin, like a cloth. A substantially front half of the seat panel 12 is attached to an upper surface of a seat-mounting shell (a seat outer shell) 11. The seat-mounting shell 11 and the seat panel 12 are injection-molded articles made of a synthetic resin, like PP (polypropylene), that is a raw material. However, they can also be formed from metal or wood.

Roughly speaking, the seat panel 12 has a first section 12*a* making up a front section and a second section 12*b* making up a back section. A group of slits 12*c* are formed in an area between the first section 12*a* and the second section 12*b* along a right-left direction of the seat 3. The slit 12*c* is formed in numbers primarily around an area on which body pressure of the seated person intensively acts (see FIG. 4, FIG. 8, and FIG. 9(A)). As shown in FIG. 9(A), both longitudinal ends of some of the slits 12*c* are jointed together by means of U-shaped reinforcement sections 12*d*, each of which has an upwardly-U-shaped cross section and is positioned such that both front-back sides of the reinforcement sections between which the slits 12*c* are interposed straddle the slits 12*c* from below. Therefore, excessive stretch of the seat panel, which would otherwise be caused by the slits 12*c*, is prevented.

The group of slits 12*c* allow downward stretching deformation of the seat panel caused by the body pressure of the seated person, as a result of which a high fitting characteristic is achieved. Moreover, the area of the seat panel 12 where the slits 12*c* are formed acts as a hinge section (i.e., a bendable area). Accordingly, the first section 12*a* and the second section 12*b* are provided so as to make a continual connection by way of the bendable hinge section. Since the seat cushion body 13 is elastically deformable, the seat 3 is divided into a first section 3*a* and a second section 3*b* in correspondence with the first section 12*a* and the second section 12*b* of the seat panel 12. The first section 3*a* and the second section 3*b* are relatively bendable when viewed sideways.

A center line (a folding line) of a curvature of the seat 3 is set to about a position that a coccygeal bone of the seated person contacts or a point located slightly in front of that position. Although the hinge of the present embodiment has a planar spread, the hinge can also be a single line. The second section 12*b* of the seat panel 12 is joined to a front facing section (a base section) 14*b* of the back cover 14 to be described later. Hence, when the back cover 14 tilts backwards while sinking (descending), the second section 12*b* (3*b*) bends itself as if it sank with respect to the first section 12*a* (3*a*).

The seat-mounting shell 11 can also be deemed to be a portion of the seat 3. Alternatively, a seat section can also be said to be made up of the seat 3 and the seat-mounting shell 11.

Figure 4:
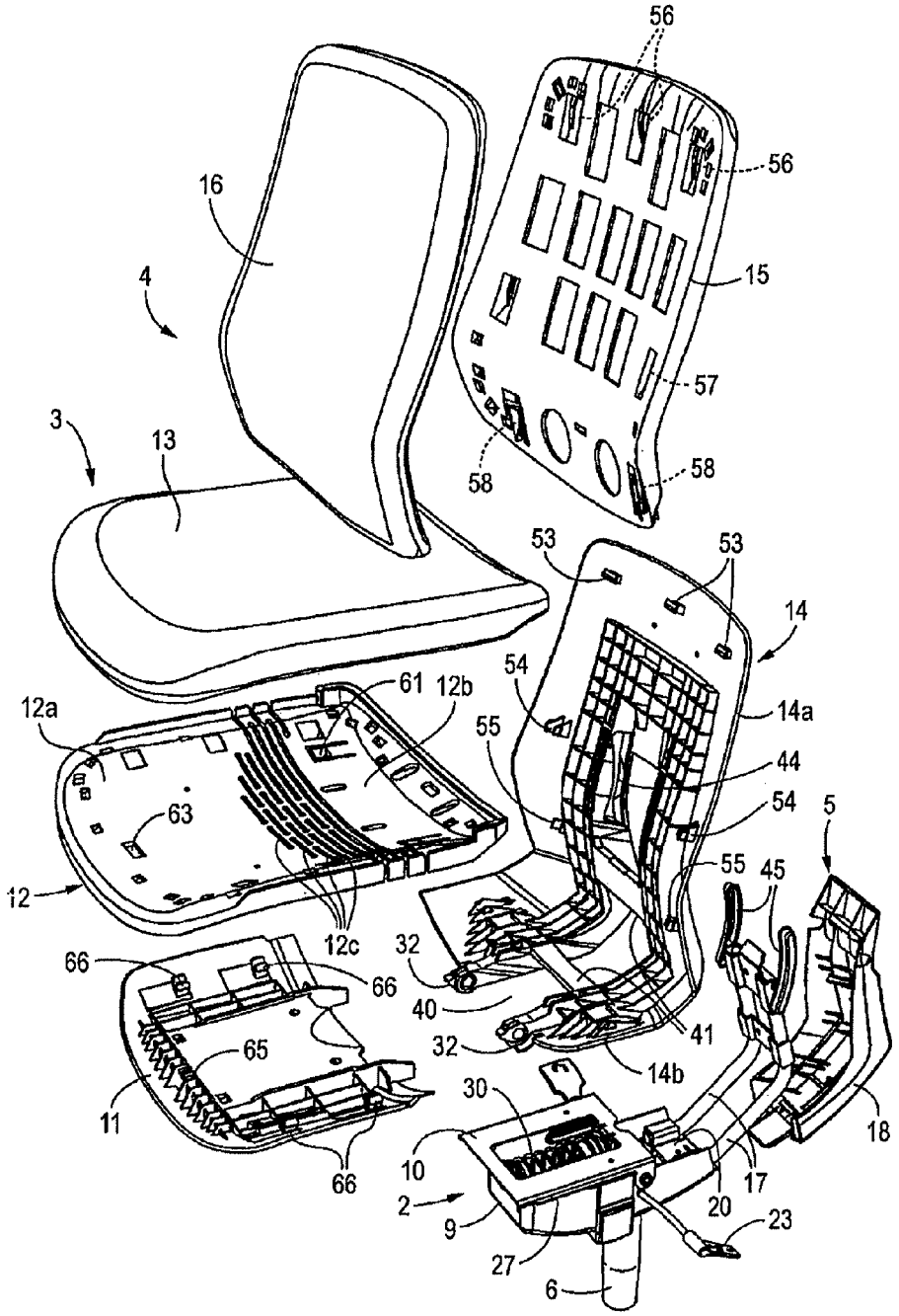
FIG. 4 is a separated perspective view.
Figure 5:
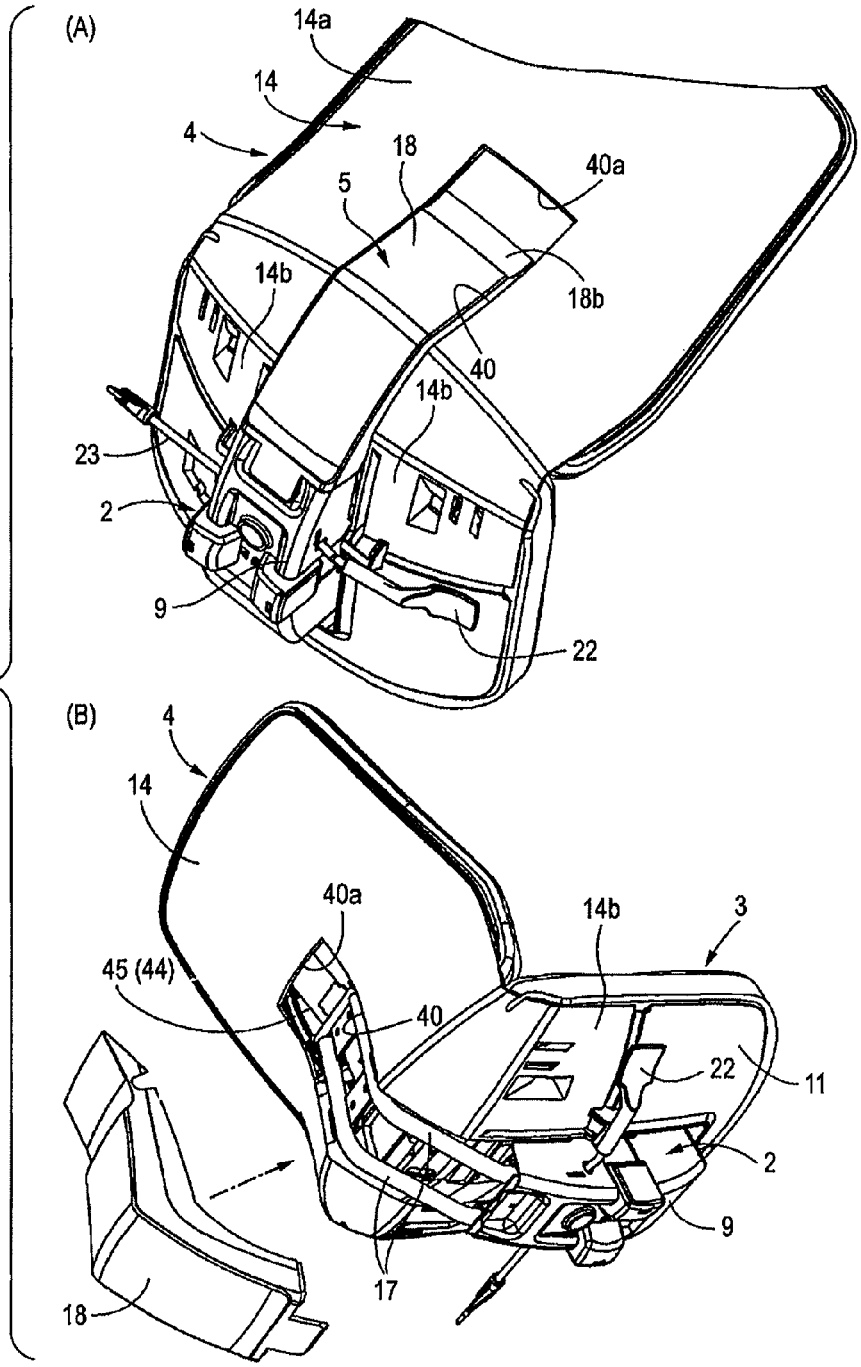
FIG. 5 (A) is a perspective view of a rear side of the rocking chair, and (B) it is a perspective view of the rear side acquired when a back support cover body is removed.

For instance, as shown in FIG. 4, the backrest 4 is primarily made up of the back cover 14, a back panel 15 attached to a front surface of the back cover 14, and a back cushion body 16 attached to a front surface of the back panel 15. A skin material, like a cloth, is stretched over the back cushion body 16. The back cover 14 can also be referred to as a back outer shell, and the back panel 15 can also be referred to as a back inner shell. The back cover 14 and the back panel 15 are injection-molded articles that use, as a raw material, a synthetic resin like PP.

The back cover 14 has a body section 14*a* that supports the back panel 15 and the front facing section 14*b* forwardly projecting from a lower end of the body section 14*a*. Accordingly, the back cover 14 assumes a substantially-L-shaped appearance when viewed sideways. As mentioned previously, the front facing section 14*b* of the back cover 14 is joined to the second section 12*b* of the seat panel 12. The back cover 14 is joined to the back support 5 so as to be able to move downwards and tilt.

When the seated person leans against the backrest 4, the backrest 4 moves downwards while tilting backwards in such a way that an upper end of the backrest 4 moves backwards and that a lower end of the same moves forwards. In the meantime, the second section 3*b* tilts backwards with respect to the first section 3*a* while the seat 3 moves forwards in its entirety. Details of the respective sections are hereunder described in detail.

(2) Back Support and Base Section

First, the back support 5 and the base section 2 are described. The back support 5 of the embodiment includes back support 17 made up of a pair of right and left pipes formed in an L-shaped form when viewed from sideways, and a support cover 18 that is removably attached to the back support 17 from behind. The right and left back support 17 are joined together by means of a reinforcement member 17*a*. In another embodiment, the back support 5 can also be formed as a single molded article made of a resin material or an aluminum molded material.

Bases of the back support 17 making up the back support 17 are welded to a base plate 19 affixed to an interior surface of the base body 9. Moreover, the bases are pressed and held by reinforcement hardware 20 (see; for instance, FIG. 4 and FIG. 6). The back support 17 can also be formed from a single pipe member or a channel member.

Figure 2:
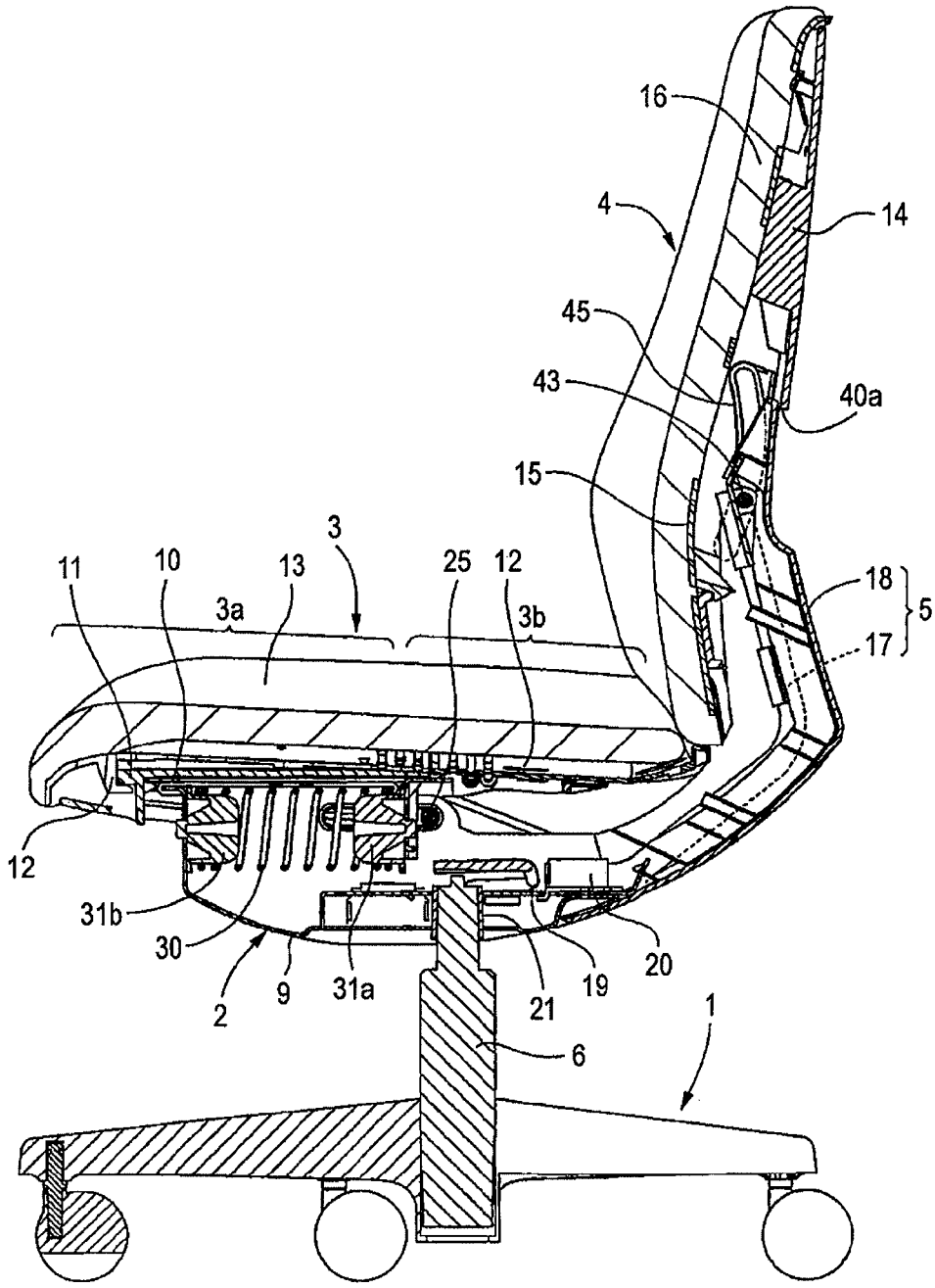
FIG. 2 is a longitudinal side elevation of the rocking chair in a non-rocking state (a normal state).
Figure 3:
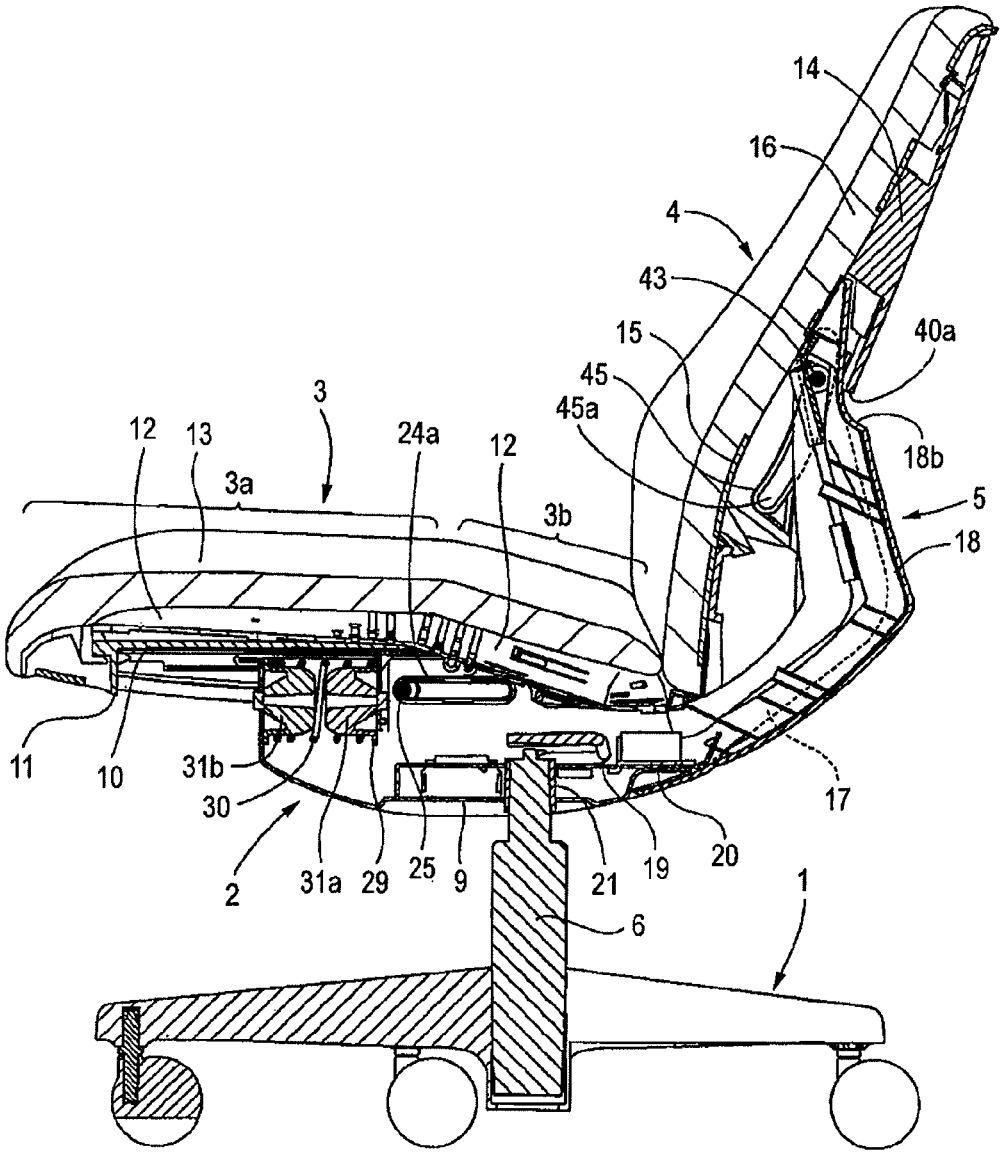
FIG. 3 is a longitudinal side elevation of the rocking chair in a rocking state.

The base body 9 assumes an upwardly-opened box-shaped appearance as mentioned previously, and a rear end of the base body 9 is opened up. The base plate 19 is welded to the interior surface of the back portion of the base body 9. For instance, as shown in FIGS. 2 and 3, a bush 21 whose top and bottom are opened is affixed to the base body 9 and the base plate 19. An upper end of the leg support 6 is fitted into the bush 21 from below. For instance, as shown in FIG. 5(A), an elevation lever 22 for actuating a push valve of the leg support 6 is provided on one side surface of the base body 9. An operation lever 23 for switching the backrest 4 between a rockable state and an unrockale state is provided on the other side surface of the base body 9.

Figure 14:
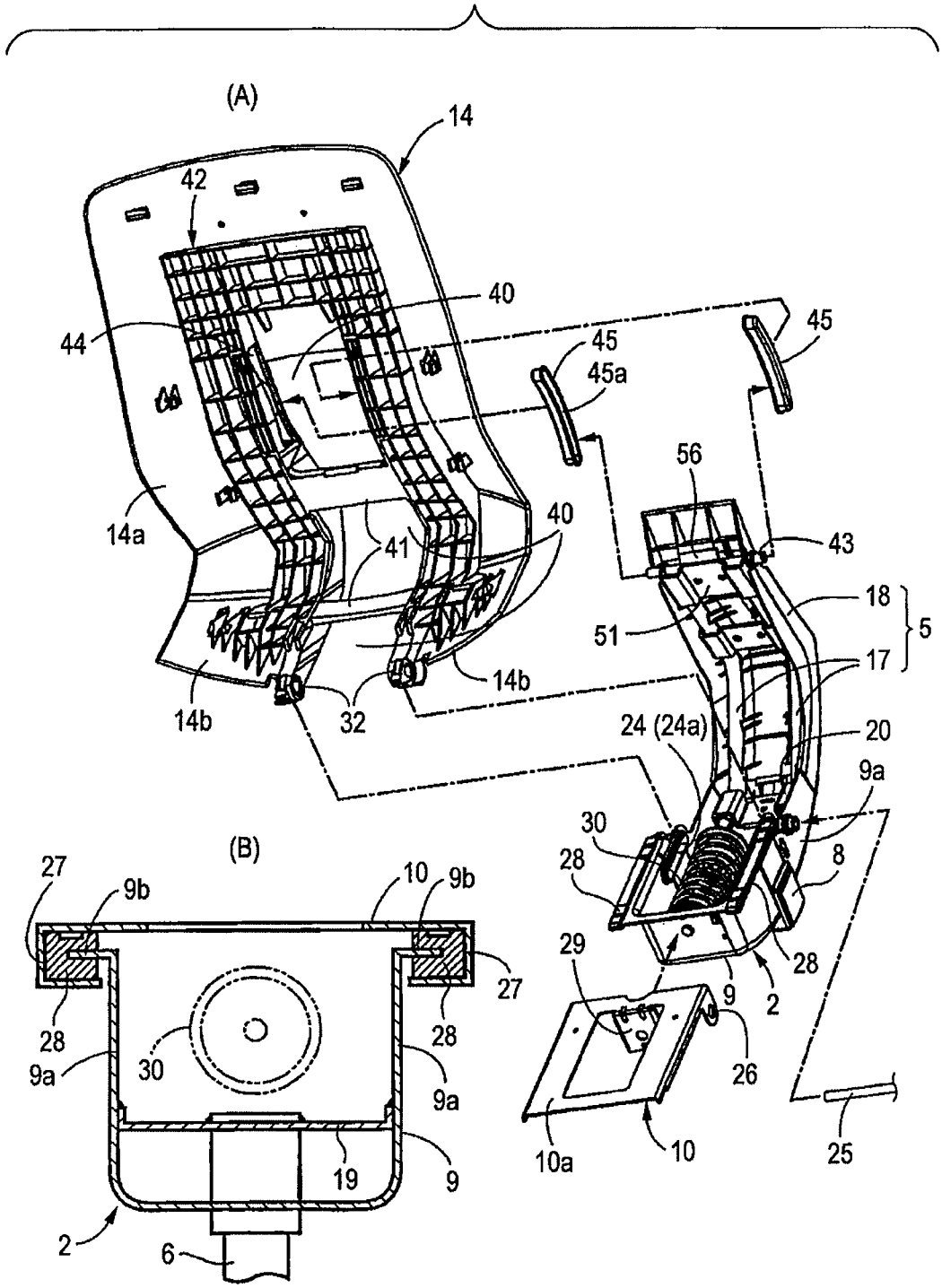
FIG. 14 (A) is a separated perspective view of principal blocks, and FIG. 14 (B) is a longitudinal front view of the base section.
Figure 15:
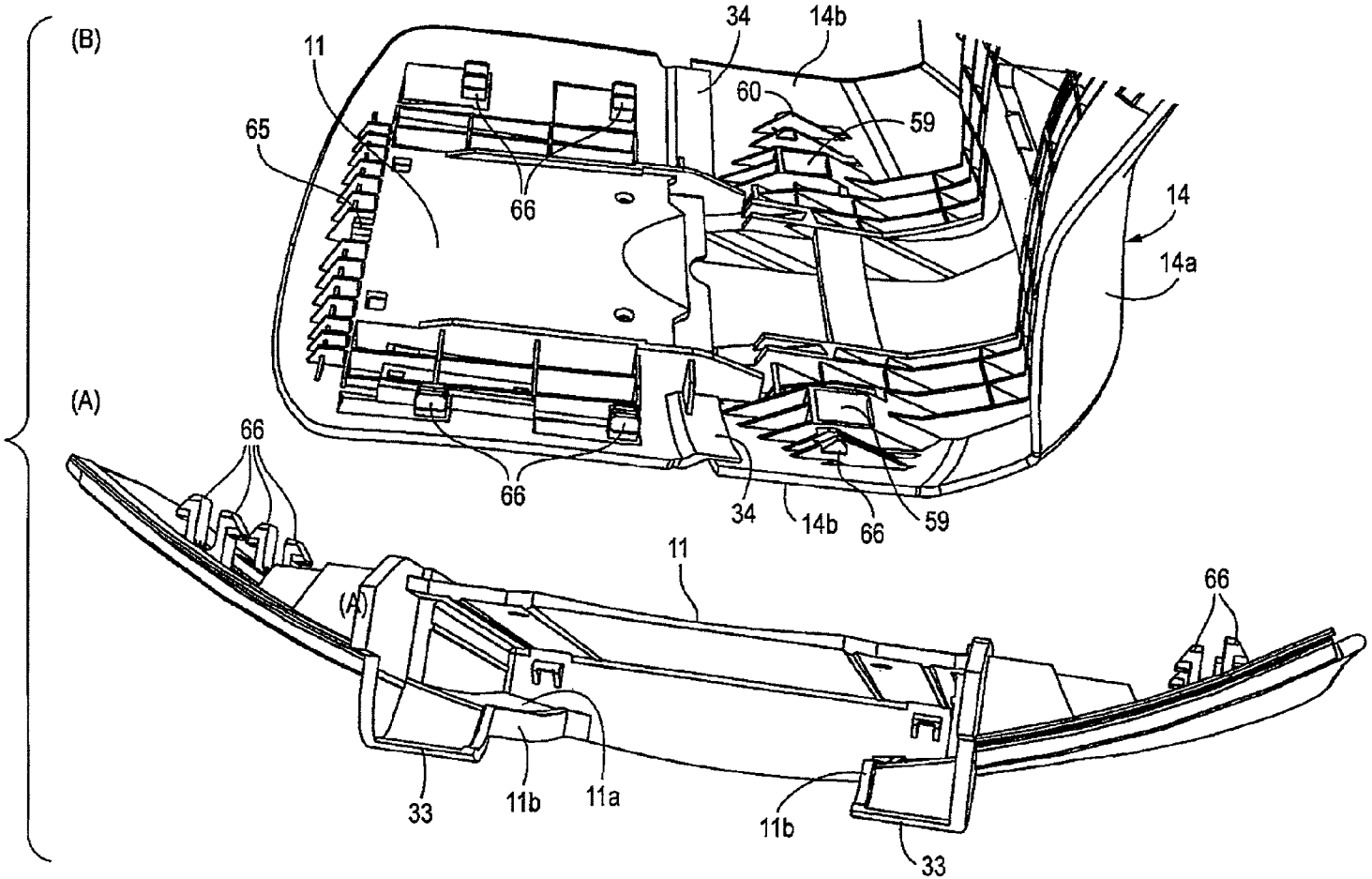
FIG. 15 (A) is a front view of a seat-mounting shell, and FIG. 15 (B) is a view showing the seat-mounting shell and the back cover.

For instance, as shown in FIG. 11(A) and FIG. 14, long holes 24 are formed on respective left and right side plates 9*a* of the base body 9 so as to be elongated along the longitudinal direction of the base body 9. A bush 24*a* made of a resin is attached to each of the long holes 24. A joint shaft 25, which is elongated in its right-left direction, is inserted into the respective right and left bushes 24*a* so as to be slidable in the front-back direction. The joint shaft 25 is inserted into the right and left sides of a rear end of the seat-mounting fixture 10. Accordingly, mount holes 26 are opened in the seat-mounting fixture 10. The seat panel 12 is screw-fastened to an upper surface of the seat-mounting fixture 10.

As shown in; for instance, FIG. 14, a rocking spring (coil spring) 30 that extends and contracts in the front-back direction is placed in the base body 9 as example rocking elastic means. On the other hand, a downwardly-oriented spring-mounting supporting piece 29 is formed at a rear end of the seat-mounting fixture 10. For instance, as shown in FIG. 2, the rocking spring 30 is supported from back by the spring-mounting supporting piece 29 by way of a back spring mount 31*a*. Further, a front end of the rocking spring 30 is supported by a front wall of the base body 9 by way of a front spring mount 31*b*. Consequently, the seat-mounting fixture 10 moves forwards in defiance of the rocking spring 30.

As shown in FIG. 14, horizontal pieces 9*b* oriented outside along the right-left direction are formed integrally on respective upper ends of the right, left side plates 9*a* of the base body 9. Slidable ancillary bodies 28 made of resin are attached to the respective horizontal pieces 9*b*. The slidable ancillary body 28 assumes a substantially-groove-like cross section so as to embrace the corresponding horizontal piece 9*b*.

A groove-shaped enfolding section 27 that enfolds each of the slidable ancillary body 28 from outside is formed on each of the right and left sides of the seat-mounting fixture 10. The enfolding sections 27 slide with respect to the respective slidable ancillary bodies 28, whereby the seat-mounting fixture 10 smoothly slides with respect to the base body 9 in the front-back direction.

Figure 16:
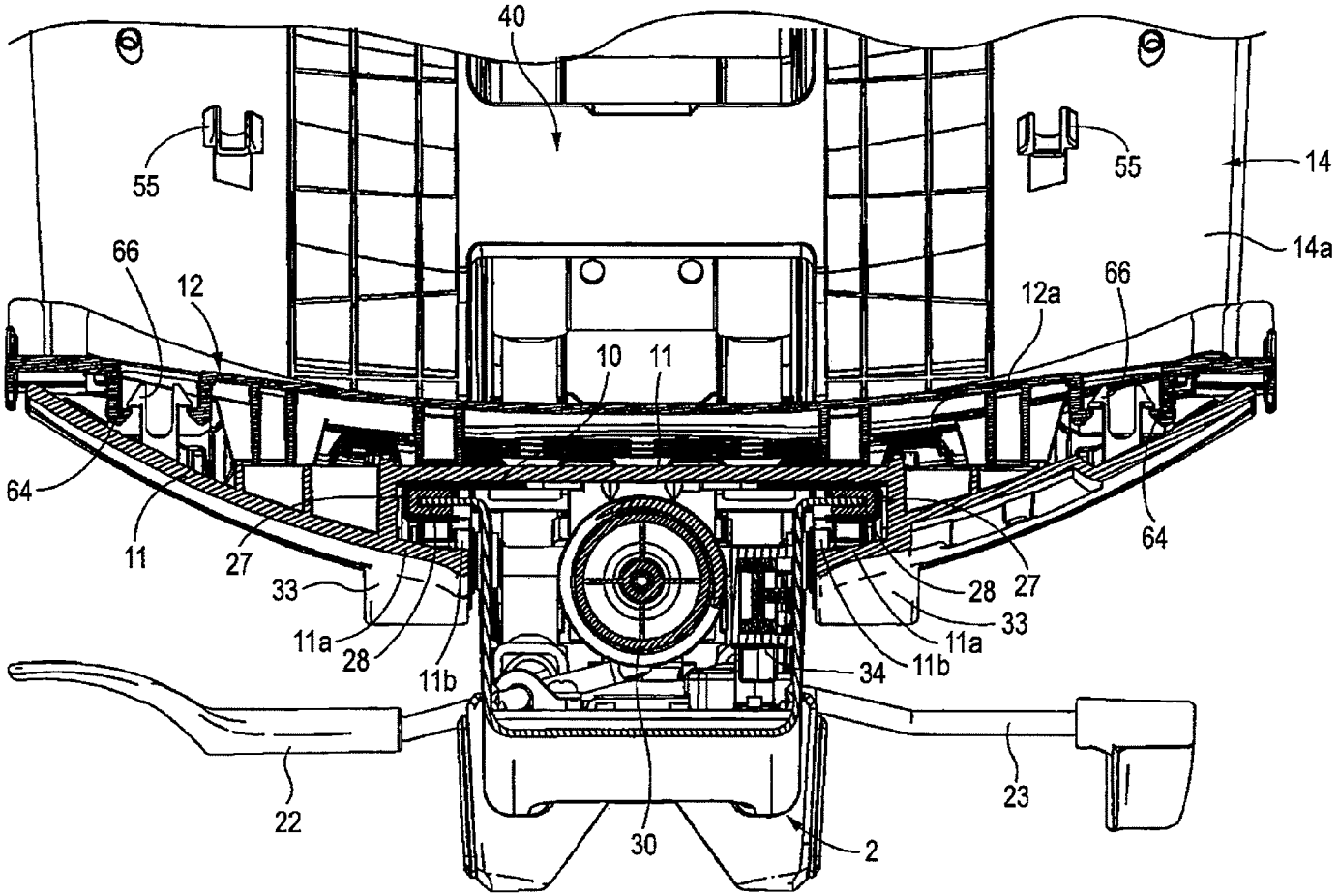
FIG. 16 is a longitudinal front view of a seat section.

As shown in FIG. 16, the seat-mounting shell 11 has receiving sections 11*a* situated below the respective enfolding sections 27 of the seat-mounting fixture 10. A weir body 11*b* is provided at a leading end of each of the receiving sections 11*a* so as to project upwards (see also FIG. 15(B)). Therefore, the receiving section 11*a* assumes the shape of an upwardly-opened watershoot. Accordingly, in a case where grease is applied over an exterior surface of the slidable ancillary bodies 28 and when the grease has dropped, the receiving sections 11*a* can receive the grease, thereby making it possible to prevent a floor from being stained with the grease. Such a configuration and advantage are not suggested or taught at all by Patent Documents 1 through 3.

As can be understood from; for instance, FIG. 14(A), a downwardly-opened long groove 40 is formed in a center of the back cover 14 along its right-left direction. Therefore, the front facing section 14*b* of the back cover 14 is split into right and left front facing sub-sections. A shaft mounting section 32 is formed at a front end of each of the right and left front facing sub-sections 14*b* of the back cover 14. The right and left shaft mounting sections 32 are connected to rear ends of the right and left side plates 9*a* of the base body 9 by means of the joint shaft 25.

As can be seen from FIG. 16, the enfolding sections 27 of the seat-mounting fixture 10 are covered with the seat-mounting shell 11. As shown in FIG. 7(A) and FIG. 15(A), a cover section 33 is formed integrally at a rear end of the seat-mounting shell 11, and the joint shaft 25 is covered with the cover section 33. For this reason, the joint shaft 25 is held so as not to fall off from the base body 9. Further, as shown in; for instance, FIG. 8 and FIG. 15(B), right and left steps 34 that are put, in an overlapping manner, on front edges of the respective front facing sections 14*b* of the back cover 14 are formed at a rear end of the seat-mounting shell 11.

Figure 6:
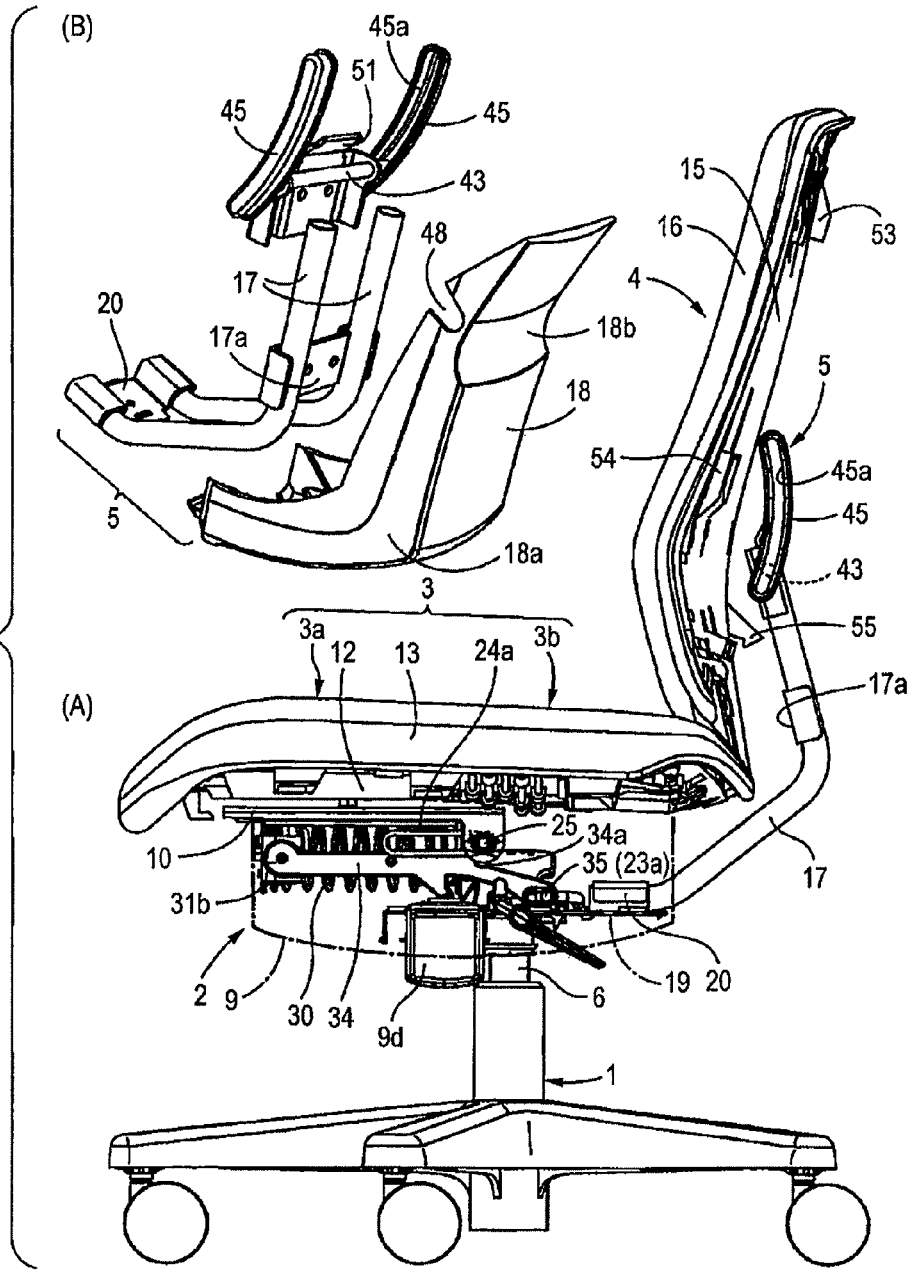
FIG. 6 (A) is a side view showing an interior of a base body, and FIG. 6 (B) is a separated perspective view of a back support when viewed from behind.
Figure 7:
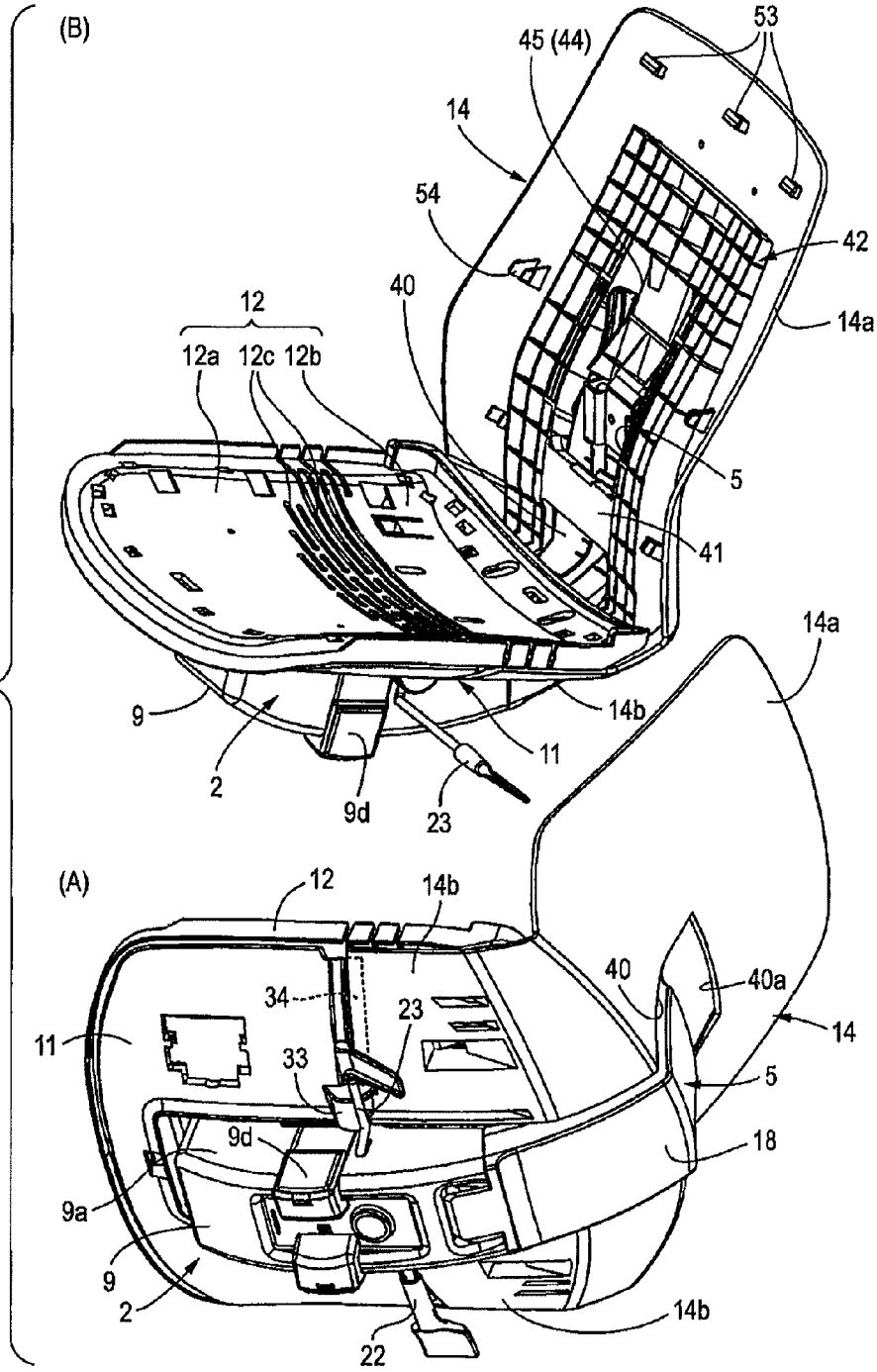
FIG. 7 (A) is a perspective view of an urn that shows an overlap between a back cover and a seat outer shell and FIG. 7 (B) is a perspective view of the back cover and the seat-mounting outer shell achieved when

As shown in FIG. 6, a lock arm 34 for switching the backrest 4 between a rockable state and an unrockable state is provided in the base body 9. The lock arm 34 is joined to the base body 9 so as to turn up and down around a front end of the lock arm 34. A long hole 35 into which a crank section 23*a* formed at a leading end of the operation lever 23 (see FIG. 7(B)) is to fit is formed on a free end of the lock arm 34.

When the operation lever 23 is turned in such a way that the crank section 23*a* moves upwards, the lock arm 34 is pushed up by way of the long hole 35. When the free end of the lock arm 34 is moved upwards, the joint shaft 25 fits into a stopper engagement section 34*a* formed in a recessed manner in an upper surface of the lock arm 34. As a result, the joint shaft 25 remains unable to move forwards, so that the backrest 4 also becomes unable to tilt backwards. When operation is performed in the reverse order, the lock arm 34 is disengaged from the joint shaft 25, so that the backrest 4 becomes able to tilt backwards.

(3) Structure of a Back Section

A structure of a back section is now described. As mentioned previously, the downwardly-opened vertically long groove 40 is formed in the back cover 14. The long groove 40 is closed by the back support 5 in both a normal state in which the backrest 4 is not in a rocking state and another state where the backrest 4 is in a rocking state.

As can be seen from; for instance, FIG. 4 and FIG. 14(A), the long groove 40 extends up to a position of an arbitrary height of the body section 14*a* of the back cover 14 along the vertical direction. A plurality of joint sections 41 that straddle the long groove 40 are formed integrally at arbitrary points on the front facing sections 14*b* along the front-back direction and an arbitrary point on the main body 14*a* along the vertical direction. By virtue of the joint sections 41, rigidity of the back cover 14 is maintained even when the long groove 40 is formed. Moreover, a group of cell-shaped reinforcement ribs 42 for enhancing rigidity are formed in an area on the interior surface of the back cover 14 corresponding to the outside of the long groove 40.

As shown in; for instance, FIG. 6(B), a reinforcement bracket 51 is affixed to an upper end of the back support 17. A guide pin 43 serving as one of backrest guide means (a guide section) described in connection with claims is affixed to the reinforcement bracket 51. Both ends of the guide pin 43 are exposed outside from both the right and left sides of the reinforcement bracket 51.

On the other hand, as clearly shown in; for instance, FIG. 9(B), vertically long guide grooves 44 are formed opposite each other as one of the backrest guide means in upper portions of the right and left side surfaces of the long groove 40 in the back cover 14. A guide member 45 having a slide groove 45*a* is fitted into each of the right and left guide grooves 44. An end of the guide pin 43 is fitted into the slide groove 45*a* of the corresponding guide member 45 so as to be slidable in the vertical direction (the guide grooves can also be said to be formed in the respective guide members 45).

Each of the guide members 45 is curved into a front facing recess at a small curvature when viewed sideways. The guide members 45 are preferably formed from resin that exhibits small sliding resistance against the metal guide pin 43 and abrasion resistance. The guide members 45 may also be formed from metal, and a sliding portion of the guide pin 43 can also be coated with fluorine. The guide members 45 may also be fixed to the guide grooves 44 and attached so as to be slightly movable. In another embodiment, the guide pin 43 can also be fitted directly into the guide grooves 44 of the back cover 14. The guide members 45 may also be provided on the back support 5, and the guide pin 43 can also be attached to the back cover 14.

The support cover 18 is removably attached to the back support 17 from behind. As shown in FIG. 11(B), substantially-U-shaped fitting grooves 46*a* to fit around the back support 17 (see FIG. 6(B)) are formed like notches in respective catch ribs 46 formed on the interior surface of the support cover 18. A remaining groove 47 is formed in an opening of each of the fitting grooves 46*a*. Therefore, the catch ribs 46 can be attached to or removed from the back support 17 by utilization of deformation in defiance to elasticity of the catch ribs 46.

The support cover 18 has right and left side plates 18*a*. Notches 48 for letting both ends of the guide pin 43 escape are formed in upper portions of the right and left side plates 18*a*. Further, as shown in FIG. 11(B), a downwardly-opened pocket-shaped fitting section 49 is formed in an upper portion of the interior surface of the support cover 18, and an engagement claw 50 is formed in a lower portion of the interior surface of the support cover 18.

Figure 13:
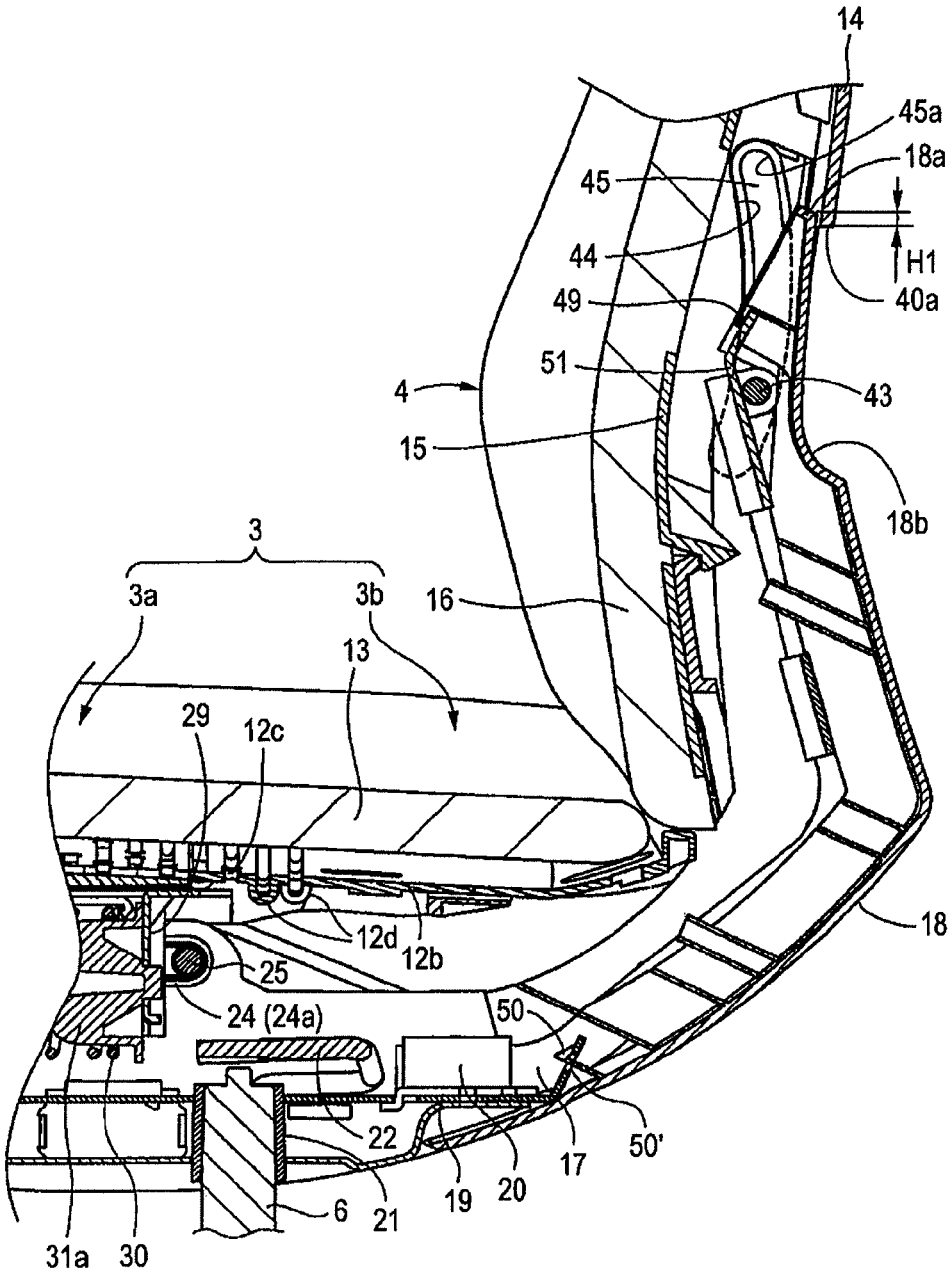
FIG. 13 is a cross sectional view taken along line XIII-XIII shown in FIG. 12.

As shown in FIG. 13, in order to attach the support cover 18 to the back support 17, the fitting section 49 is fitted to an upper end of the reinforcement bracket 51 from above; the catch ribs 46 are fitted to the back support 17; and also the engagement claw 50 is fitted to an engagement hole 50' formed in a rear end of the base plate 19.

In order to assemble the back section, processing should go through a sequence of attaching the support cover 18 to the back support 17, attaching the back cover 14 to the back support 17, and attaching the back panel 15 to the back cover 14. The support cover 18 can also be finally attached to the back support 17 (FIG. 5(B) shows the attachment).

As shown in; for instance, FIG. 13, upper ends of the guide grooves 44 and the guide members 45 are situated at positions higher than an upper end edge 40*a* of the long groove 40. In the normal state where the backrest 4 is not in a rocking state, an upper end edge of the support cover 18 is folded inside (toward an up side) of the upper end edge of the long groove 40 by a slight dimension H1. Put another way, the upper end of the support cover 18 is covered with the back cover 14 from behind even in the normal state.

When the chair is rocked, the back cover 14 moves downwards while turning (pivoting) in a seesaw manner around the guide pin 43. However, the support cover 18 is stationary and does not move even in the rocking state. Hence, the guide pin 43 is always covered with the back cover 14 and the support cover 18. Therefore, superior appearance is accomplished, and there is little chance of; for instance, a finger of a person being caught between the guide pin 43 and the back cover 14 (safety can be assured).

As mentioned previously, in a rocking state, the backrest 4 tilts backwards while sinking with respect to the back support 5 assuming a constant posture. However, in this case, the movement of the back cover 14 cannot be hindered by the support cover 18. Further, spacing sufficient for insertion of a finger must not exist between the back cover 14 and the support cover 18. Accordingly, when the chair rocks, the back cover 14 must be vertically moved while the upper end edge 40*a* of the long groove 40 is held in proximity to the support cover 18.

In the embodiment, a back surface of the back cover 14 and a back surface of the support cover 18 are set so as to be substantially aligned to each other in the normal state that is taken as a standard state. However, on the occasion of rocking action, the back cover 14 tilts in such a way that the lower end of the back cover 14 comes to the near side. Hence, the upper end edge 40*a* of the long groove 40 plots a locus that moves downwards while moving to the near side. Accordingly, as shown in FIG. 3 and FIG. 13, a portion of the support cover 18 where the back cover 14 slides is stepped inside. Therefore, a step 18*b* is formed in the support cover 18. If the step 18*b* has a sharp edge, the finger may be caught by the step. Hence, the step 18*b* is formed into a back-oriented rounded recess.

Needless to say, from the viewpoint of superior appearance and prevention of catching of a finger, it is preferable to minimize spacing between the interior side surfaces of the long groove 40 and the side plates 18*a* of the support cover 18. In the present embodiment, the upper end of the support cover 18 is inserted into the interior of the back cover 14, thereby making up cover means described in connection with the claims.

Fitting of engagement claws is adopted as a method for attaching the back panel 14 to the back cover 14. As shown in; for instance, FIG. 7, three upper-row horizontally-arranged engagement claws 53 are projectingly arranged side by side at an upper end of a front surface of the back cover 14. Middle-row engagement claws 54 are arranged on both sides, in the horizontal direction, of and at substantially intermediate arbitrary points on the front surface of the back cover 14 in the vertical direction. Lower-row engagement claws 55 are projectingly provided on both right and left sides of a lower portion of the front surface of the back cover 14. On the other hand, three rows of engagement sections 56, 57, and 58, only the positions of which are merely shown in FIG. 4, are provided on the back panel 15 in correspondence with the engagement claws 53, 54, and 55 of the back cover 14.

Figure 12:
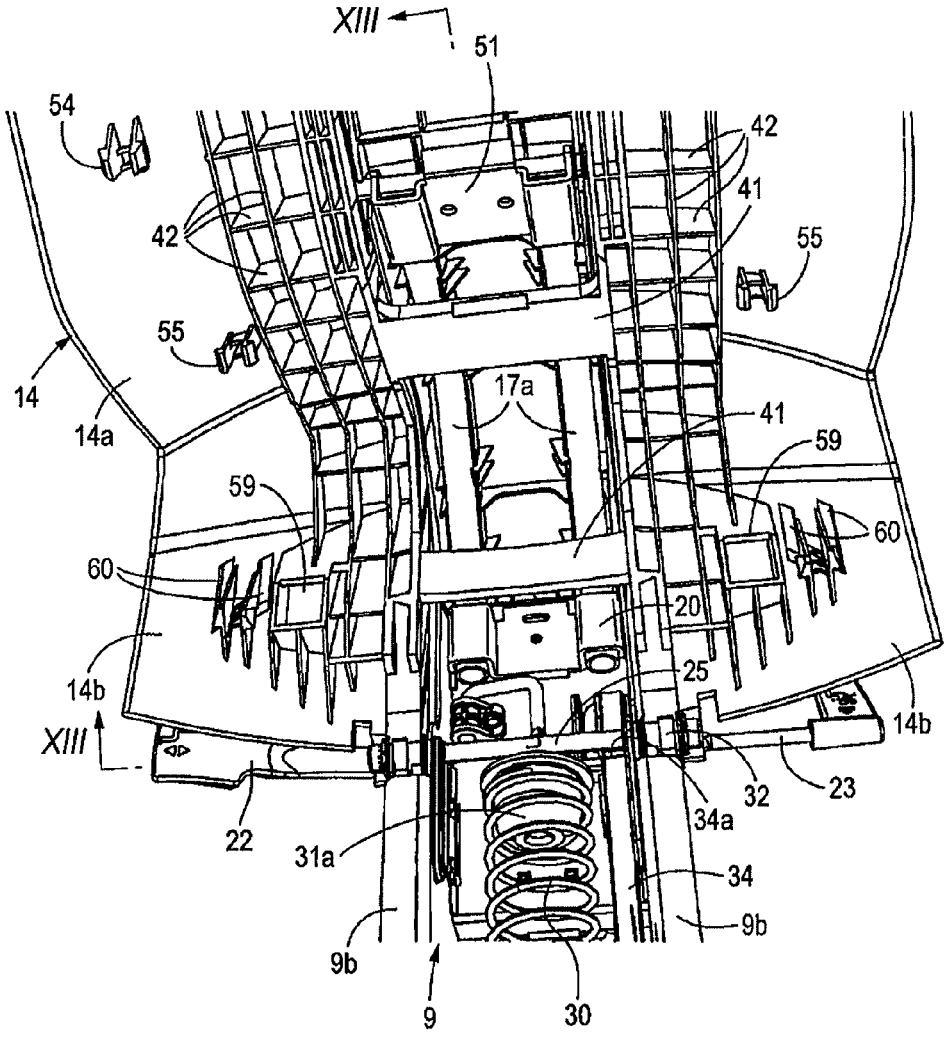
FIG. 12 is a partially cutout perspective view showing a relationship between the back cover and the base section.

A catch technique is adopted as means for joining the second section 12*b* of the seat panel 12 to the front facing sections 14*b* of the back cover 14. As shown in FIG. 12, a rear joint hole 59 whose top and bottom are opened is formed in each of the right and left front facing sections 14 of the back cover 14, and a rear engagement claw 60 having a hook shape when viewed from front is formed outside the rear joint hole 59. As shown in FIG. 9(A), a rear stopper 61 to fit into the rear engagement hole 59 and a second side engagement claw 62 to slidably engage with the rear engagement claw 60 from front are formed on the second section 12*b* of the seat panel 12.

As a result of the second side engagement claws 62 engaging with the respective rear engagement claws 60, the second section 12*b* is held so as to be unable to move in the horizontal direction and also unable to separate from the respective front facing sections 14*b* in the upward direction. As a result of the rear stoppers 61 fitting into the respective rear engagement holes 60, the second section 12*b* is held so as to be unable to move in the front-back direction.

Figure 8:
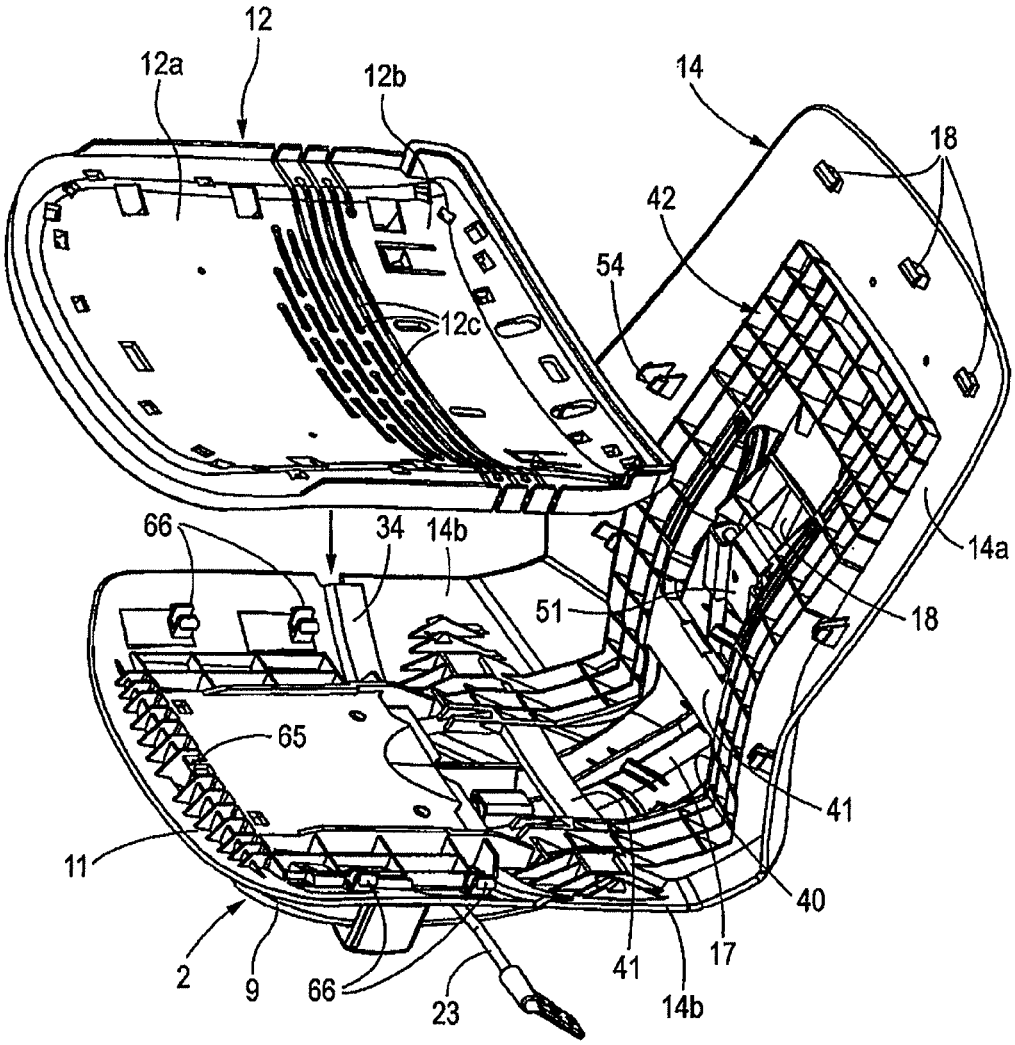
FIG. 8 is a separated perspective view of the seat outer shell and a seat inner shell.
Figure 9:
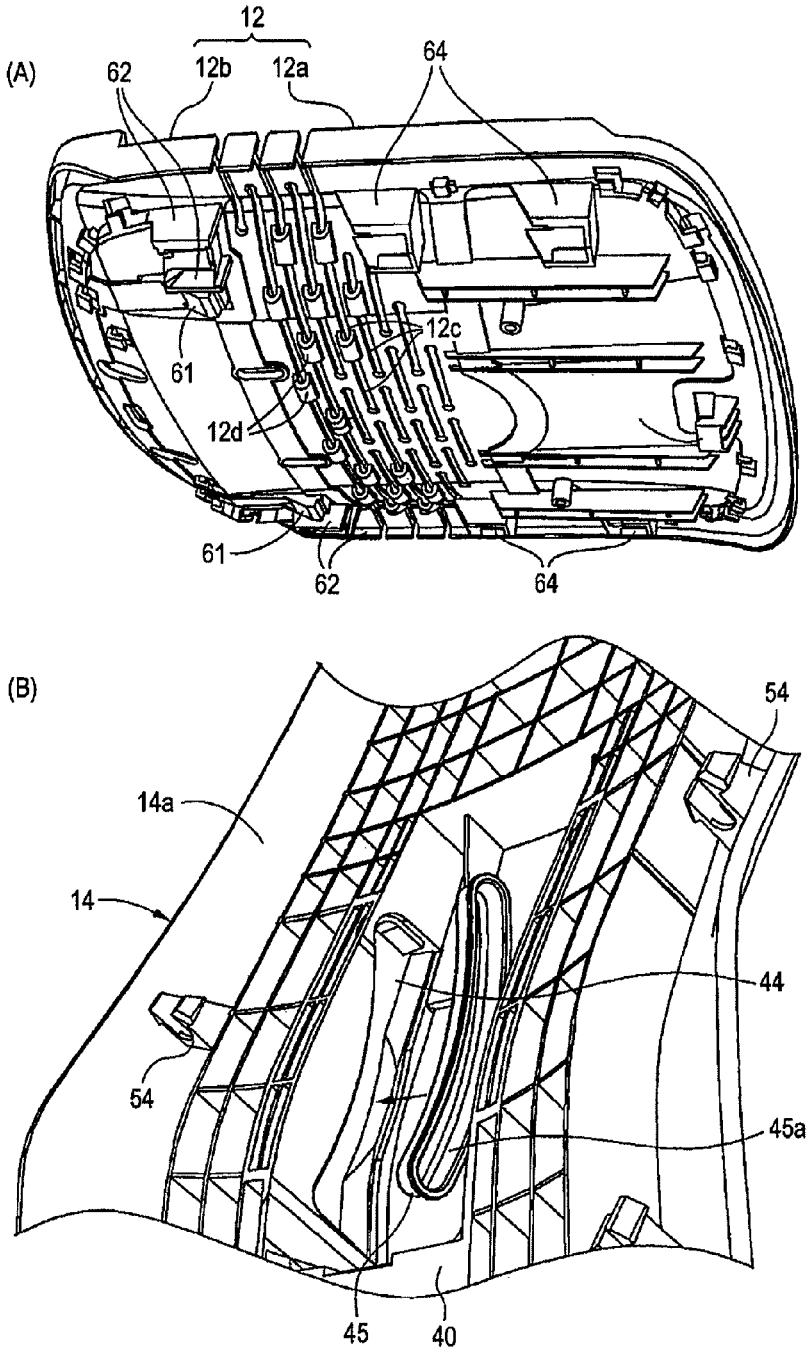
FIG. 9 (A) is a perspective view of the seat inner shell acquired when viewed from below and FIG. 9 (B) is a partial perspective view of the back cover.
Figure 10:
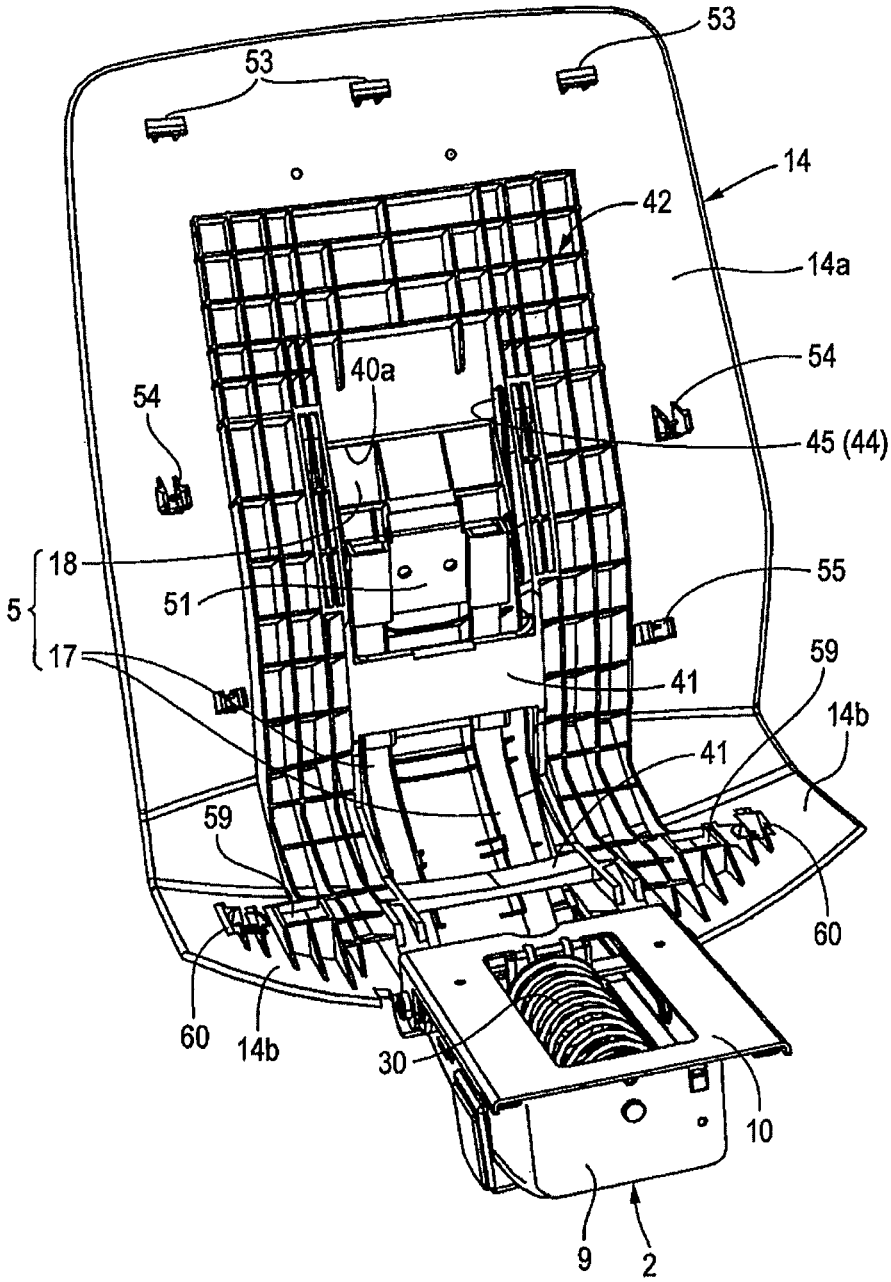
FIG. 10 is a perspective view showing the seat outer shell, a base section, and a back support.
Figure 11:
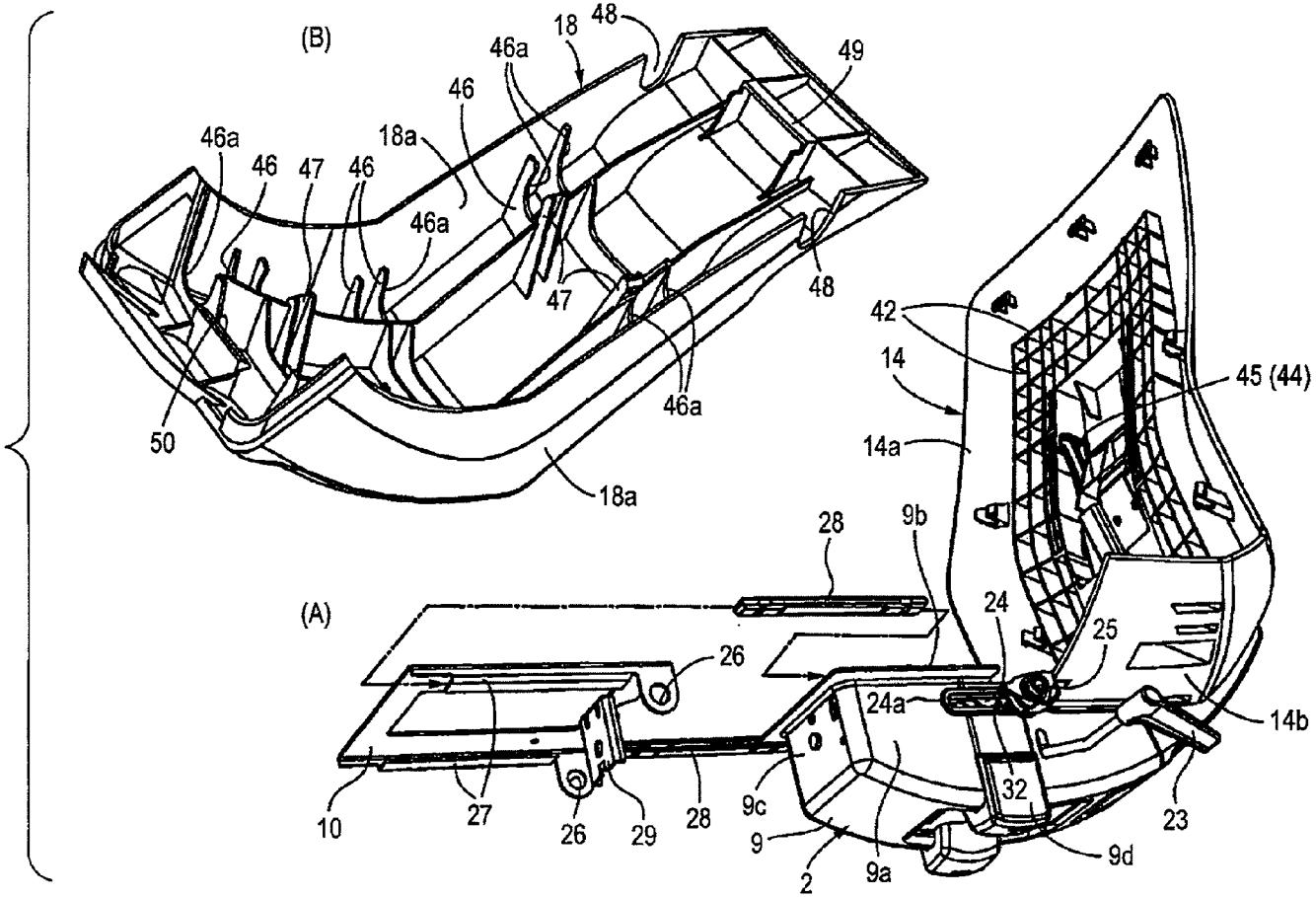
FIG. 11 (A) is a perspective view of the base section acquired when the base section is viewed from below while partially separated, and FIG. 11 (B) it is a perspective view of a support cover.

The first section 12*a* of the seat panel 12 is also jointed to the seat-mounting shell 11 by the catch means. As shown in FIG. 9, an upper front stopper 63 having a hook shape when viewed sideways is formed at an intermediate position of the front portion, in the horizontal direction, of the first section 12*a* of the seat panel 12. Further, a pair of first female side engagement claws 64 arranged in the front-back direction are formed on each of the right and left sides of the first section 12*a* of the seat panel 12. As shown in FIG. 8, a lower front stopper 65 with which the front stopper 63 is to engage from front is formed on the seat-mounting shell 11. Further, first male side engagement claws 66, each of which has a hook shape when viewed from front, are formed on the seat-mounting shell 11. The first female side engagement claws 64 slidably engage with the first male side engagement claws 66 from front.

As a result of the first female side engagement claws 64 engaging with the first male side engagement claws 66, the first section 12*a* of the seat panel 12 are held so as to be unable to move in both the horizontal and upward directions. Further, as a result of the upper front stopper 63 engaging with the lower front stopper 65 from the near side, the first section 12*a* of the seat panel 12 is also held so as to be unable to move in the backward direction. Forward movement of the seat panel 12 is hindered as a result of the rear stoppers 61 of the second section 12*b* engaging with the rear engagement holes 60 of the back cover 14.

(4) Summary of the First Embodiment

In the above structure, in a rocking state, the second section (back section) 3*b* tilts backwards while the seat 3 is moving forwards in its entirety. Moreover, the backrest 4 moves downwards while turning (pivoting) in a seesaw fashion around the vertically middle arbitrary point on the backrest acting as a fulcrum. Hence, the seated person is enfolded by the backrest 4 and the seat 3 in the rocking state. Therefore, a comfortable rocking state can be realized (advantages of the basic movements are described after explanation of a second embodiment).

The location of the guide pin 43 that joins the back support 5 to the back cover 14 is covered at all times with the back cover 14 and the support cover 18 during rocking action. Hence, superior appearance and safety are accomplished. Moreover, the steps 34 on the rear end of the seat-mounting shell 11 and the front end of the front facing section 14*b* of the back cover 14 vertically overlap each other. Hence, a finger of the person will not be caught between the seat-mounting shell 11 and the back cover 14, so that safety is assured accordingly.

The back support 17 and the guide pin 43 can also be fully covered with the back cover 14. However, in this case, the back cover 14 must be situated behind the back support 17 in a rocking state, such as that shown in FIG. 3. Hence, the back cover 14 greatly bulges in the backward, which terribly worsens the appearance of the chair. On the contrary, in the present embodiment, the back support 5 is placed in the long groove 40 of the back cover 14, thereby preventing the guide pin 43 from being exposed. Hence, the entirety of the chair becomes simple, so that safety can be assured while superior appearance is accomplished. This is one of the advantages of the present embodiment.

Various means can be selected as means for synchronously actuating the backrest 4 and the seat 3. In the present embodiment, the seat-mounting fixture 10 and the front facing section 14*b* of the back cover 14 are joined together by means of the joint pin 25 that is slidable in the front-back direction. As a result, the backrest 4 and the seat 3 can be smoothly actuated by a simple structure in a synchronous manner without fail. This is also one of the advantages of the present embodiment. The upper end of the support cover 18 is inserted into the back cover 14, whereby the support cover 18 cannot be forcefully opened from above. Hence, the chair is also superior even in that the support cover 18 is held in an attached state.

A line-shaped hinge (a fold line) can also be provided as means for separating the seat panel 12 into the first section 12*a* and the second section 12*b*. However, the slits 12*c* are formed so as to be aligned in the front-back direction, such as that described in connection with the embodiment, thereby forming the hinge section having a width in the front-back direction. As a result, the seat 3 bends itself at a gentle curvature during rocking action, so that there is yielded an advantage of preventing the seated person from having uncomfortable feeling.

(5) Summary of a Second Embodiment

Next, a second embodiment is described. Members having functions in common with the members described in connection with the first embodiment are assigned the same reference numerals. Explanations about the members having the same functions as those of the members described in connection with the first embodiment are basically omitted. In the present embodiment, the backrest 4 is attached to back support 68. A lumber support 8 that forwardly pushes an area where a hip of the seated person contacts is interposed between the back support 68 and the backrest 4. The lumber support 8 is supported by the back support 68 in such a way that the height of the lumber support 8 can be adjusted from behind.

The chair also has the base body 9 whose top is opened even in the present embodiment. First intermediate fixture 69 is attached to the base body 9 so as to be slidable in the front-back direction by way of a first pin 70. A second intermediate fixture 72 is joined to a rear end of the first intermediate fixture 69 by means of a horizontally-long second pin (a first support shaft) 71. The seat 3 is supported by the first intermediate fixture 69 and the second intermediate fixture 72 by way of the seat-mounting shell 11. The base section 2 additionally has a lower bracket 73 fixed to a lower surface of the base body 9. The back support 17 is affixed to the lower bracket 73.

The first pin 70 is slidably fitted into a second long hole 74 that is formed in the base body 9 and horizontal along the front-back direction. The second pin 71 is also slidably fitted in a second long hole 75 that is formed in the base body 9 and horizontal along the front-back direction. Therefore, the first intermediate fixture 69, the second intermediate fixture 72, and the seat-mounting shell 11 and the seat 3 that are supported by them are slidable in the front-back direction. Further, the second intermediate fixture 72 can tilt around the second pin 71.

The seat-mounting shell 11 is separated into a first section 11*a* that accounts for about two-thirds of a front facing portion of the seat-mounting shell 11 and a second section 11*b* that accounts for about one-third of a back facing portion of the same. The first section 11*a* is attached to the first intermediate fixture 69, and the second section 11*b* is attached to the second intermediate fixture 72. Moreover, the seat 3 is also made up of a first section 3*a* that accounts for about two-thirds of a front facing portion of the seat 3 and a second section 3*b* that accounts for about one-third of a back facing portion of the same. Both the sections 3*a* and 3*b* are bendably continuous in such a way that the second section 3*b* tilts backwards with respect to the first section 3*a*.

The first section 3*a* of the seat 3 is affixed to the first section 11*a* of the seat-mounting shell 11, and the second section 3*b* of the seat 3 is affixed to the second section 11*b* of the seat-mounting shell 11. Accordingly, the seat 3 in its entirety slides in the front-back direction, and the second section 3*b* can tilt backwards with respect to the first section 3*a* when viewed sideways. It can be said that an about 5:5 to 7:3 ratio is appropriate as a dimensional ratio of the first section 3*a* to the second section 3*b* in the front-back direction.

A back surface of an area of the backrest 4 close to its upper end is fixed to upper ends of the back support 68. Further, a downwardly-oriented stopper 76 is provided at a lower end of the backrest 4. The downwardly-oriented stopper 76 remains in contact with a horizontally-oriented stopper 77 provided on the back support 68 from behind so as to be movable in the vertical direction. Therefore, the lumber support 8 is vertically moved, to thus make it possible to change a projection mode of the backrest 4.

A guide body 78 is affixed to point on the respective back support 68 close to their upper ends (i.e., substantially intermediate points on the backrest 4 along the vertical direction). The guide body 78 is fitted to the guide pin 43 provided at an upper end of the back support 17 so as to be vertically slidable. Accordingly, when the seated person leans against the backrest 4, the backrest 4 wholly moves downwards while an upper end of the backrest 4 is moving backwards in a tilting manner and while a lower end of the same is moving forwards. The second section 3*b* tilts backwards while the entirety of the seat 3 moves forwards.

Each of the armrest devices 7 has an arm support 79 fixed to the lower bracket 73, an elevation body 80 attached to the arm support 79 in such a way that a height of the elevation body 80 is adjustable, and an arm pad 81 attached to an upper end of the elevation body 80. The arm pad 81 assumes a narrowly-elongated shape when viewed from above and is attached to the elevation body 80 so as to be turnable in the horizontal direction. Further, the arm support 79 is attached to the lower bracket 73 so as to be turnable in the front-back direction. More precisely, in a state in which the arm support has been fully turned in the forward direction, the arm support remains tilted forwardly at a slight angle θ1 with respect to the normal line. In a state in which the arm support has been fully tilted backwards, the arm support tilts backwards (is inclined in the backward direction) at an angle θ2 that is larger than the front tilt angle θ1. A turn angle (θ1+θ2) of the entire arm support is set to about 25° (preferably within a range from 20 to 30°).

When performing work, such as keyboard operation, while his/her arms resting on the arm pads 81, the arm pads 81 must be set so as to be about the same height as that of a desk top plate D or slightly higher than the height. However, when the arm rest devices 7 are stationary and do not swing, the arm pads 81 collide against the top plate D, so that the chair cannot be slid deep into the desk. On the contrary, in the present embodiment, the arm rest devices 7 tilt (turn) back and forth, so that the chair can be slid deep into the desk. As a consequence, a preferable working position can be selected.

Each of the arm rest devices 7 is pushed in a forward tilting direction by means of an absorber 82 having a built-in spring. Further, each of the arm pads 81 is pushed by a built-in attitude retaining device of the corresponding armrest device 7 so as to return to a landscape orientation in which one end of the arm pad 81 is situated above the seat 3. The arm pads 81 can also be slid without resistance in the longitudinal (the horizontal direction) in the landscape orientation. Further, the arm pads 81 are set so as to retain their postures in a non-portrait orientation in which the arm pads extend in the front-back direction.

(6) Details of the Base Section

Detailed structures of the base section 2 and the seat 3 are now described. First, details of the base section 2 are described. As can be seen from; for instance, FIG. 22, an ancillary bracket 83 is welded to an interior surface of the rear portion of the base body 9, and the upper end of the leg support 1 is fitted to the bush 21 that is fixed to the base body 9 and the ancillary bracket 83.

Figure 21:
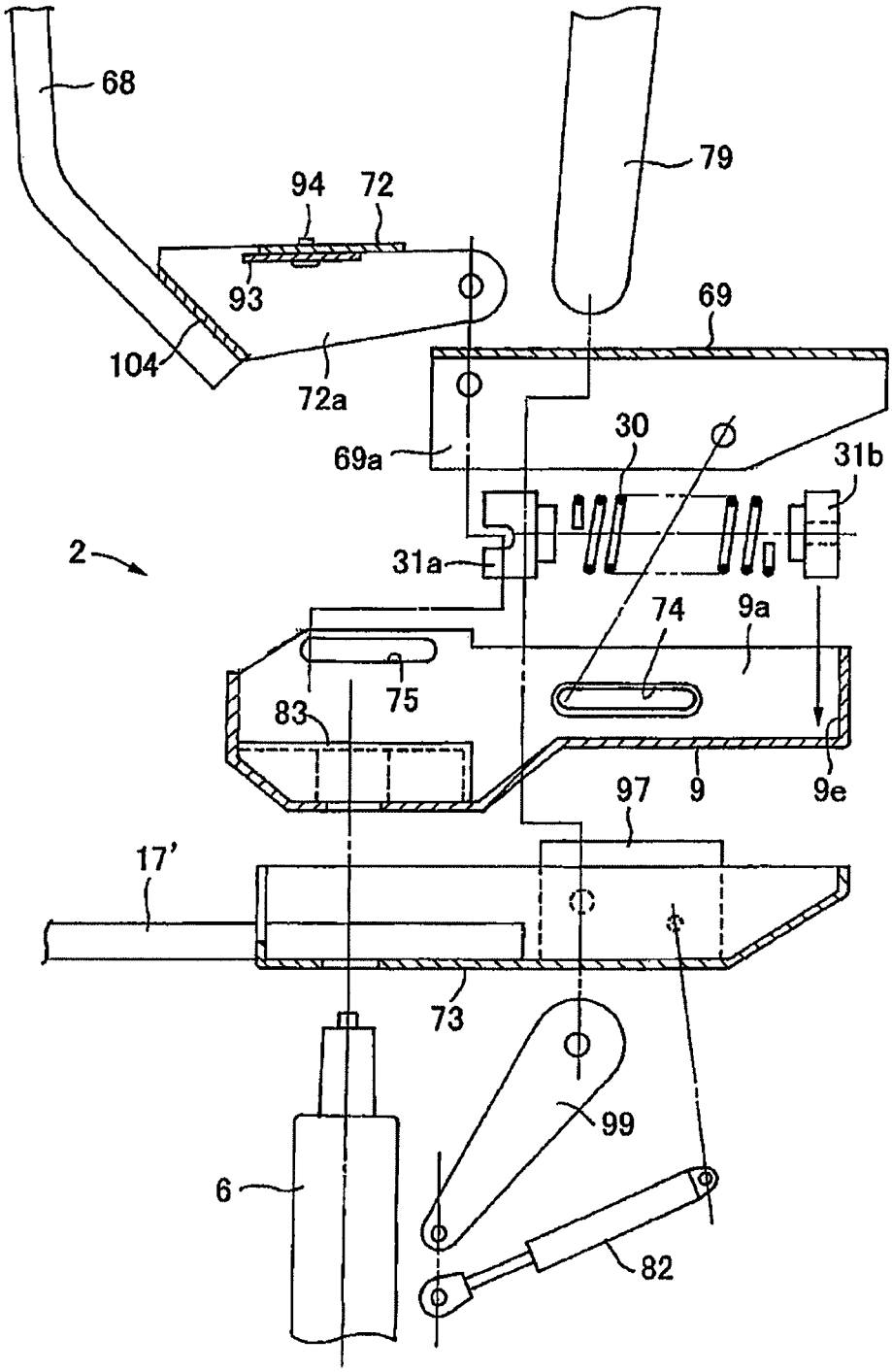
FIG. 21 is a cross sectional view of a separated side of a principal member.
Figure 22:
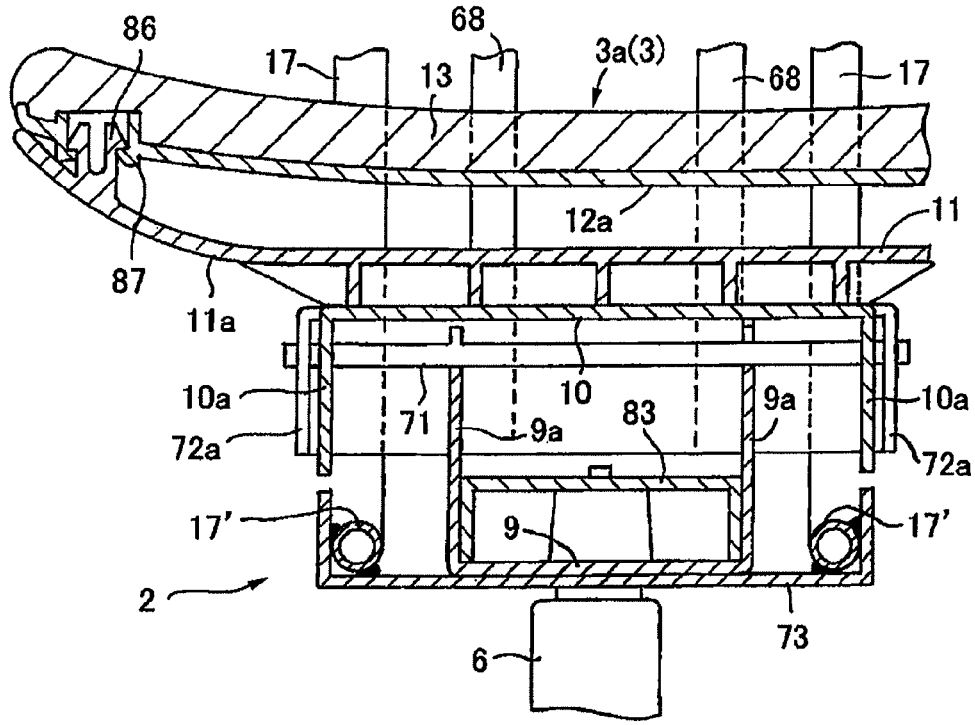
FIG. 22 is a cross sectional view taken along line XXII-XXII shown in FIG. 20 while showing the entirety of the chair.

For instance, as shown in FIG. 22, the first intermediate fixture 69 assumes the shape of a groove that covers the base body 9 from above and that is downwardly opened. The first pin 70 and the second pin 71 penetrate through a side plate 69*a*. As shown in; for instance, FIG. 18 and FIG. 21, the second long hole 74 and the second long hole 75 are formed in each of the side plates 9*a* of the base body 9. Although a bush made of a resin is fitted into the second long holes 74, the bush can also be fitted to the second long holes 75, as well.

Figure 18:
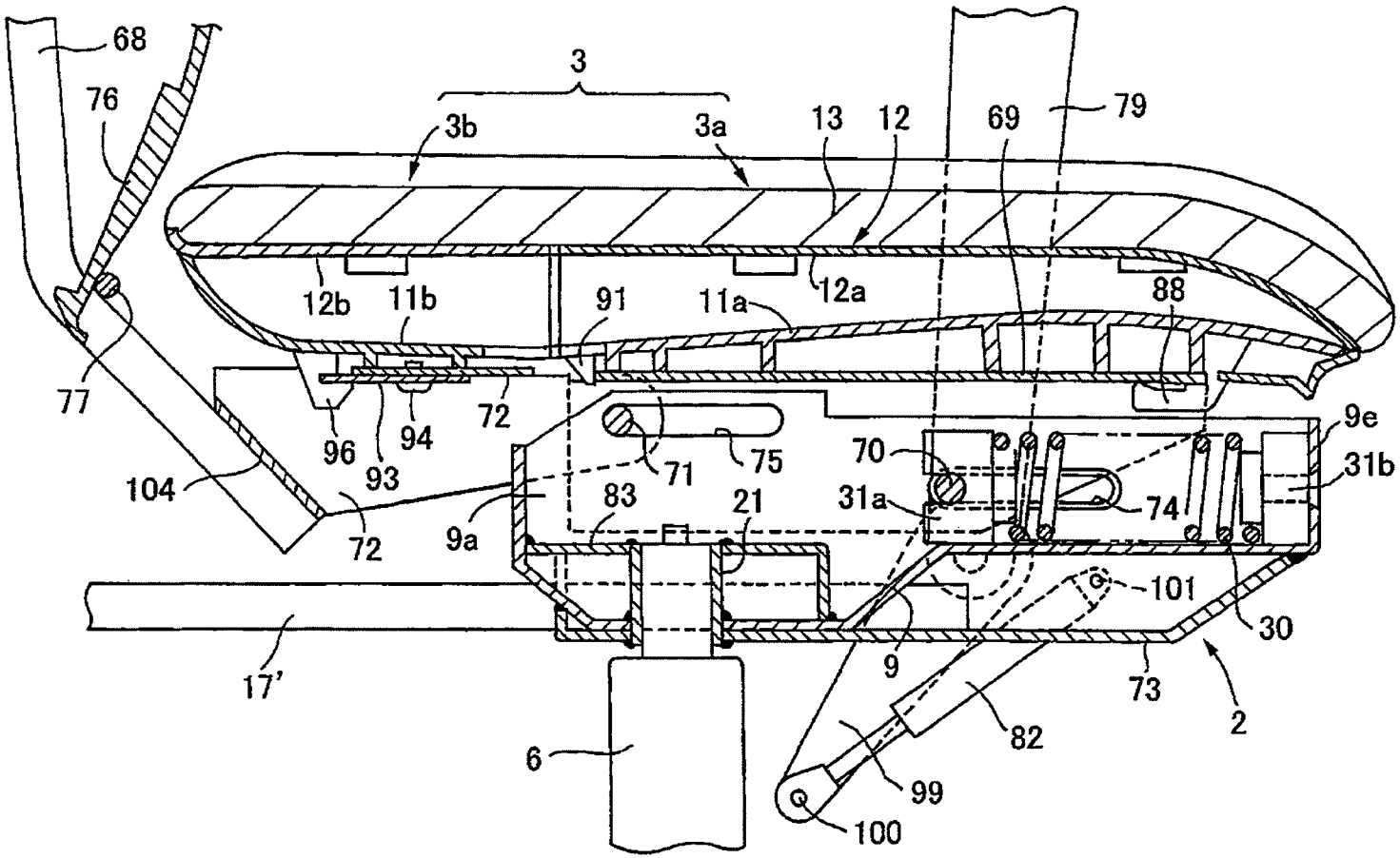
FIG. 18 is a longitudinal side elevation of the second embodiment.

For instance, as shown in FIG. 18, the base body 9 has a front plate 9*e*, and the front spring mount 31*b* is fixed to the front plate 9*e* with screws. The back spring mount 31*a* is supported from behind by the first pin 70. A groove into which the first pin 70 is to fit and whose back is opened is formed in the back spring mount 31*b*. A bottom plate of the base body 9 forms a step at a position below the front spring mount 31*b*, the back spring mount 31*a*, and the rocking spring 30. The front spring mount 31*b* and the back spring mount 31*a* are retained by the step in a non-rotatable manner.

As shown in FIG. 22, a horizontal width of the first intermediate fixture 69 is considerably larger than a horizontal width of the base body 9. On the other hand, the lower bracket 73 has an upwardly-opened shape and assumes substantially the same horizontal width as that of the first intermediate fixture 69. A horizontal section 17' of the back support 17 is welded to both right and left ends of the lower bracket 73.

The second intermediate fixture 72 assumes a groove that has a top plate and right and left side plates 72*a* and that is downwardly opened when viewed from front. The right and left side plates 72*a* are situated outside the first intermediate fixture 69, and the second pin 71 penetrates through the side plates 72*a*. The right and left side plates 72*a* project forwardly from the top plate, and the second pin 71 penetrates through the forwardly-projecting portions.

(7) Structure of the Seat and Attaching Means

Figure 23:
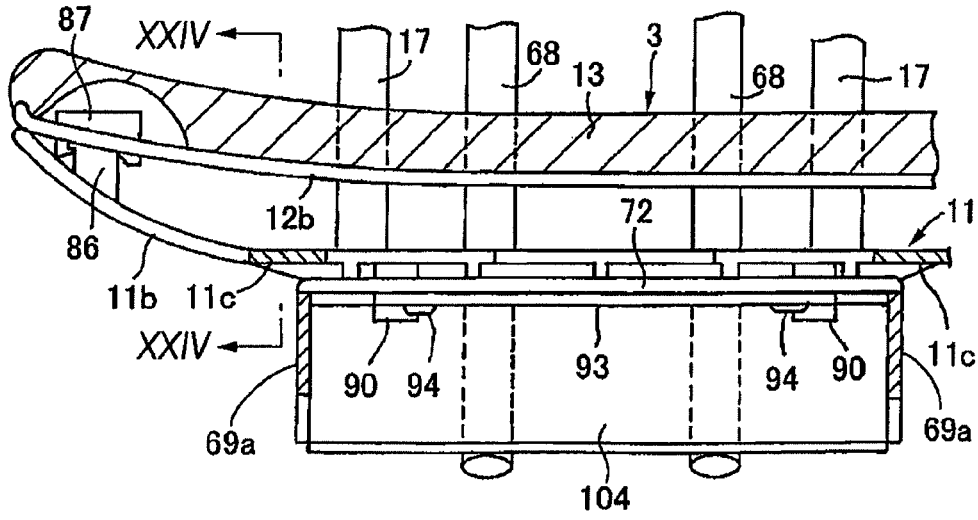
FIG. 23 is a cross sectional view taken along line XXIII-XXIII shown in FIG. 20 while showing the entirety of the chair.

As can be seen from FIG. 22 and FIG. 23, the entirety of the seat-mounting shell 11 assumes the shape of an upwardly-opened shallow tray. As shown in FIG. 18, a rear end of the seat-mounting shell assumes the shape of a wall that rises upright while gently being curved upwards.

Figure 20:
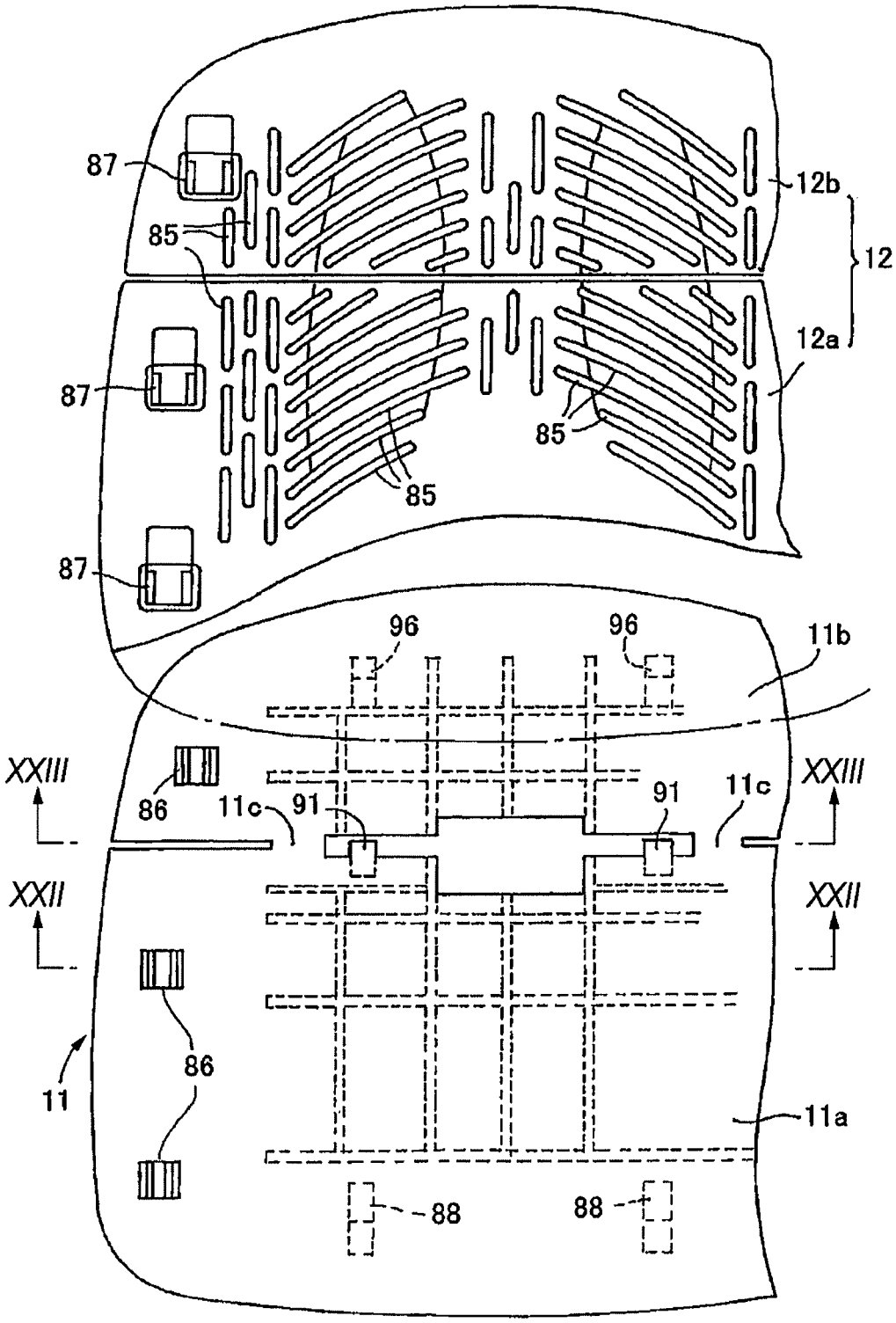
FIG. 20 is a separated plan view of the outer shell and a seat inner shell.

As shown in FIG. 20, a plurality of slits 85 are formed primarily in the area of the seat panel 12 on which the body pressure of the seated person intensively acts. The group of slits 85, allow downward extension and deformation, which would be caused by the body pressure of the seated person. As a consequence, a high cushioning characteristic is yielded. The seat panel 12 is separated into the first section 12*a* and the second section 12*b* in correspondence with the seat 3, whereby flexion of the seat 3 is allowed.

In the present embodiment, the entirety of the seat cushion body 13 is continuous. However, the seat cushion body 13 can be separated into a first section and a second section, whereby the entirety of the seat 3 can be configured in a separated manner.

As shown in FIG. 20 and FIG. 22, the seat panel 12 and the seat-mounting shell 11 are integrally joined together by means of engaging male engagement sections 86 and female engagement sections 87 provided on the respective left and right ends with each other. The female engagement sections 87 are engaged into the male engagement sections 86 from above. Next, the seat panel 12 is slid backwards, whereupon the engagement sections mesh with each other, whereby the seat panel 12 and the seat-mounting shell 11 are held so as to be unable to separate from each other in the vertical direction.

Figure 19:
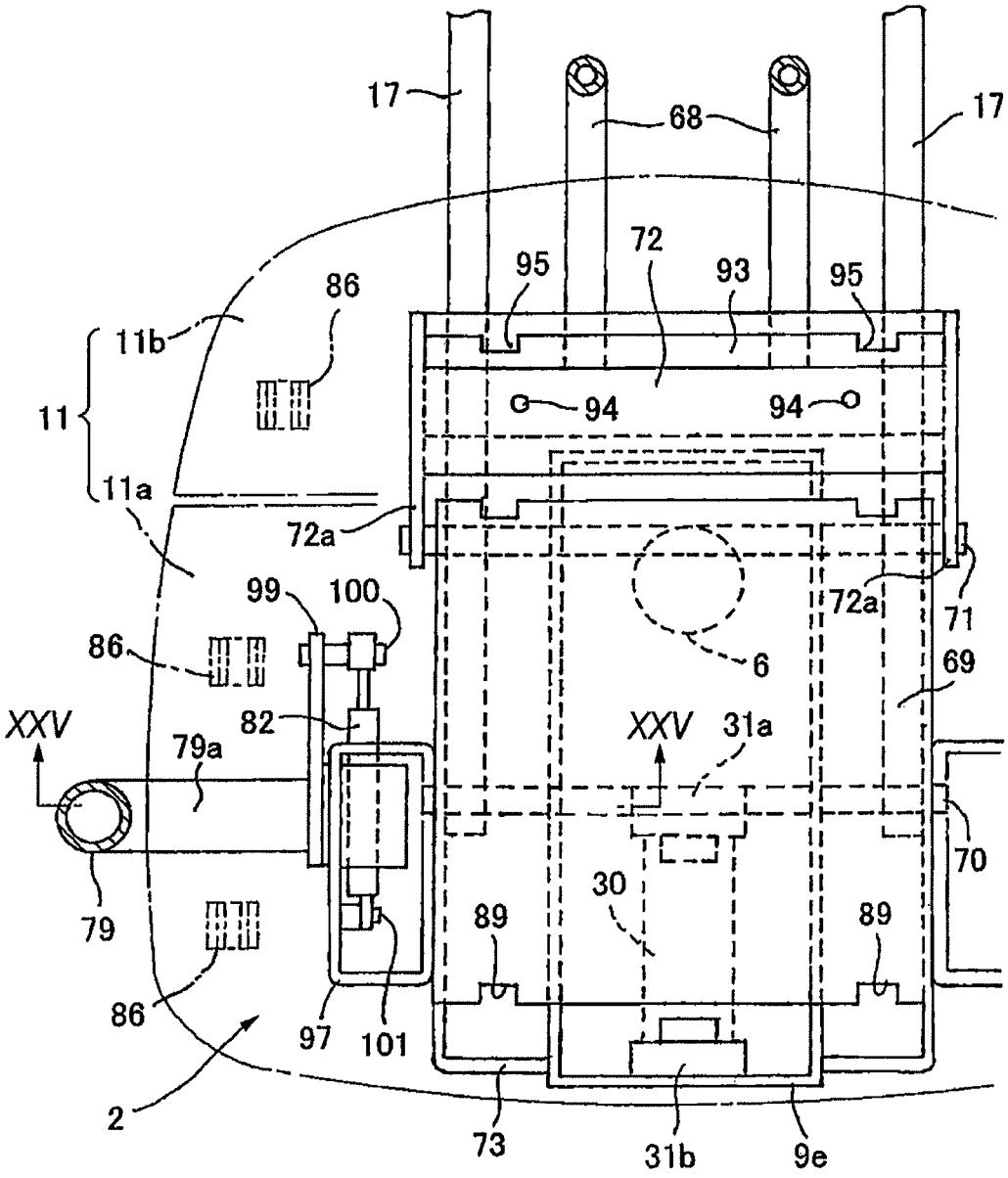
FIG. 19 is a plan view showing an outer shell by a phantom line.

As shown in FIG. 18, a pair of right and left front engagement claws 88 that fit to a top plate of the first intermediate fixture 69 from the near side are formed in an area of the seat-mounting shell 11 close to the front end of the first section 11*a*. Moreover, as shown in FIG. 19, front notches 89 into which the front engagement claws 88 are to fit without involvement of horizontal displacement are formed in the first intermediate fixture 69. A rear stopper 91 that fits into a rear cutout 90 formed in the rear end of the first intermediate fixture 69 is formed in the rear end of the first section 11*a* of the seat-mounting shell 11. Accordingly, the first section 11*a* of the seat-mounting shell 11 is held by the first intermediate fixture 69 so as not to be susceptible to front-back and right-left displacements or upward removal.

On the other hand, as shown in FIG. 18 and FIG. 19, a stopper plate 93 extending backwards from the top plate are fixed to a lower surface of the top plate of the second intermediate fixture 72 with screws 94. Two cutouts 95 are formed on the right and left sides on a rear edge of the stopper plate 93. Moreover, rear engagement claws 96 that fit to the notches 95 of the stopper plate 93 from behind are formed in the second section 11*b* of the seat-mounting shell 11. Accordingly, the seat-mounting shell 11 is held by the front-back engagement claws 88 and 96 so as not to undergo upward removal.

As shown in FIG. 20 and FIG. 23, the first section 11*a* and the second section 11*b* of the seat-mounting shell 11 are continual by way of right and left hinge sections 11*c*. The hinge sections 11*c* assume a horizontal posture when viewed from front. Therefore, the seat-mounting shell 11 bends itself around the hinge sections 11*c*. Put another word, the second section 11*b* tilts backwards around the hinge sections 11*c*.

Figure 24:
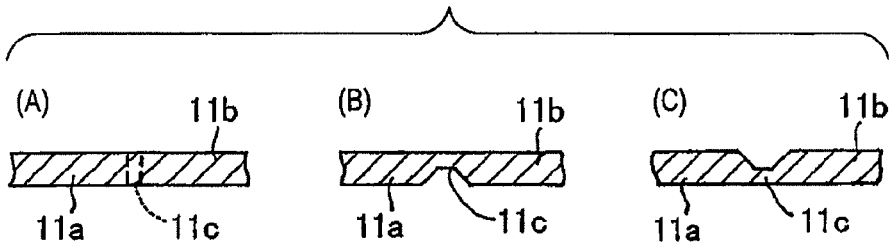
FIGS. 24 (A), (B), and (C) are cross sectional views taken along line XXIV-XXIV shown in FIG. 23.

FIG. 24 illustrates an example cross sectional profile of the hinge section 11*c*. In FIG. 24(A), the hinge section 11*c* is formed so as to have the same thickness as those of the first and second sections 11*a* and 11*b* without involvement of special working. In FIG. 24(B), a trapezoidal groove (or a V-shaped groove) is formed in a lower surface so as to have a smaller thickness. In FIG. 24(C), a trapezoidal groove (or a V-shaped groove) is formed in an upper surface so as to have a small thickness. In FIGS. 24(B) and (c), the hinge sections 11*c* are vulnerable to flexure. A plurality of ribs extending in every direction are formed on the lower surfaces of both sections 11*a* and 11*b* making up the seat-mounting shell 11.

Figure 25:
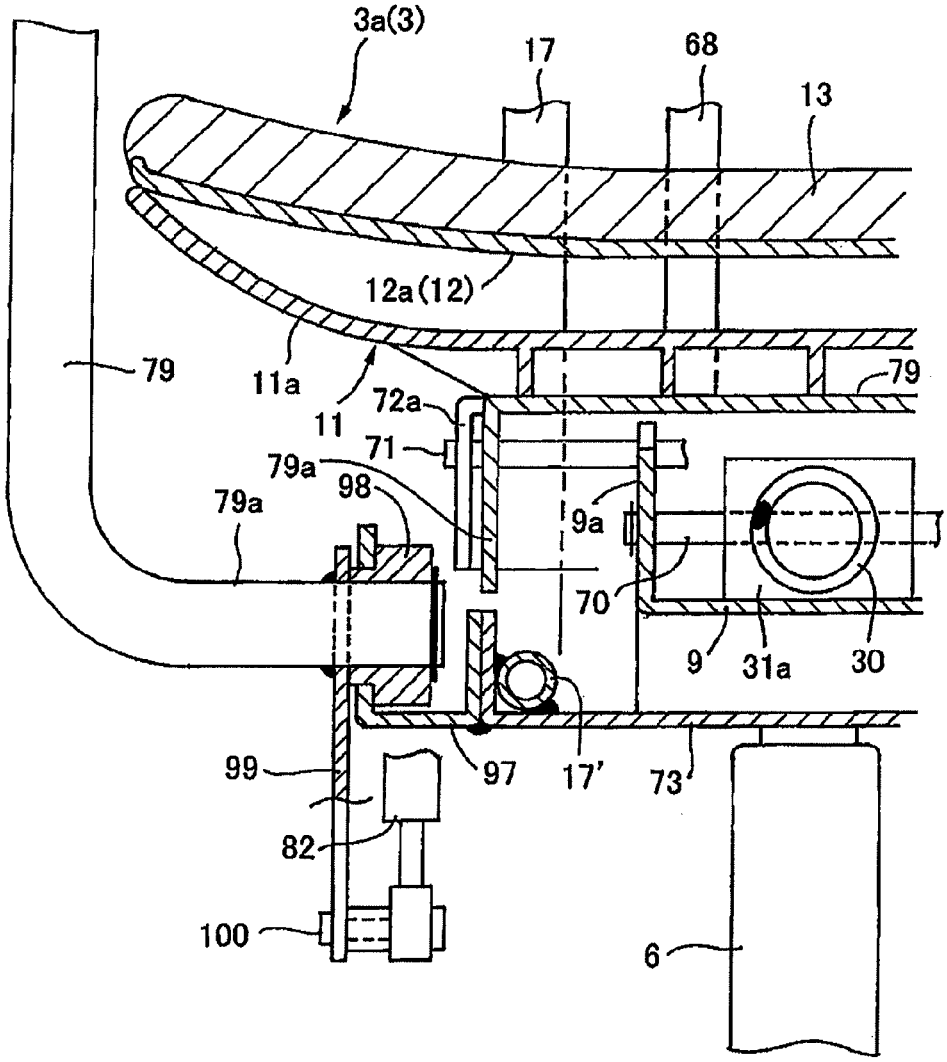
FIG. 25 is a cross sectional view taken along line XXV-XXV shown in FIG. 19.

As shown in; for instance, FIG. 25, each of the arm supports 79 has an inwardly-oriented horizontal section 79*a*. The horizontal section 79*a* is attached to a side bracket 97, which is welded to the side surface of the lower bracket 73, by way of a bush 98 so as to be turnable in the front-back direction. A downwardly-oriented arm 99 is fixed to a position on the horizontal section 79*a* that is outside the side bracket 97. The absorber 82 is joined to a lower end of each of the downwardly-oriented arms 99 and each of the side brackets 97 by way of pins 100 and 101 so as to be turnable in a relative fashion. A hole (not shown) for letting the absorber 82 escape is formed in each of the side brackets 97.

(8) Structure of the Back Section

Figure 26:
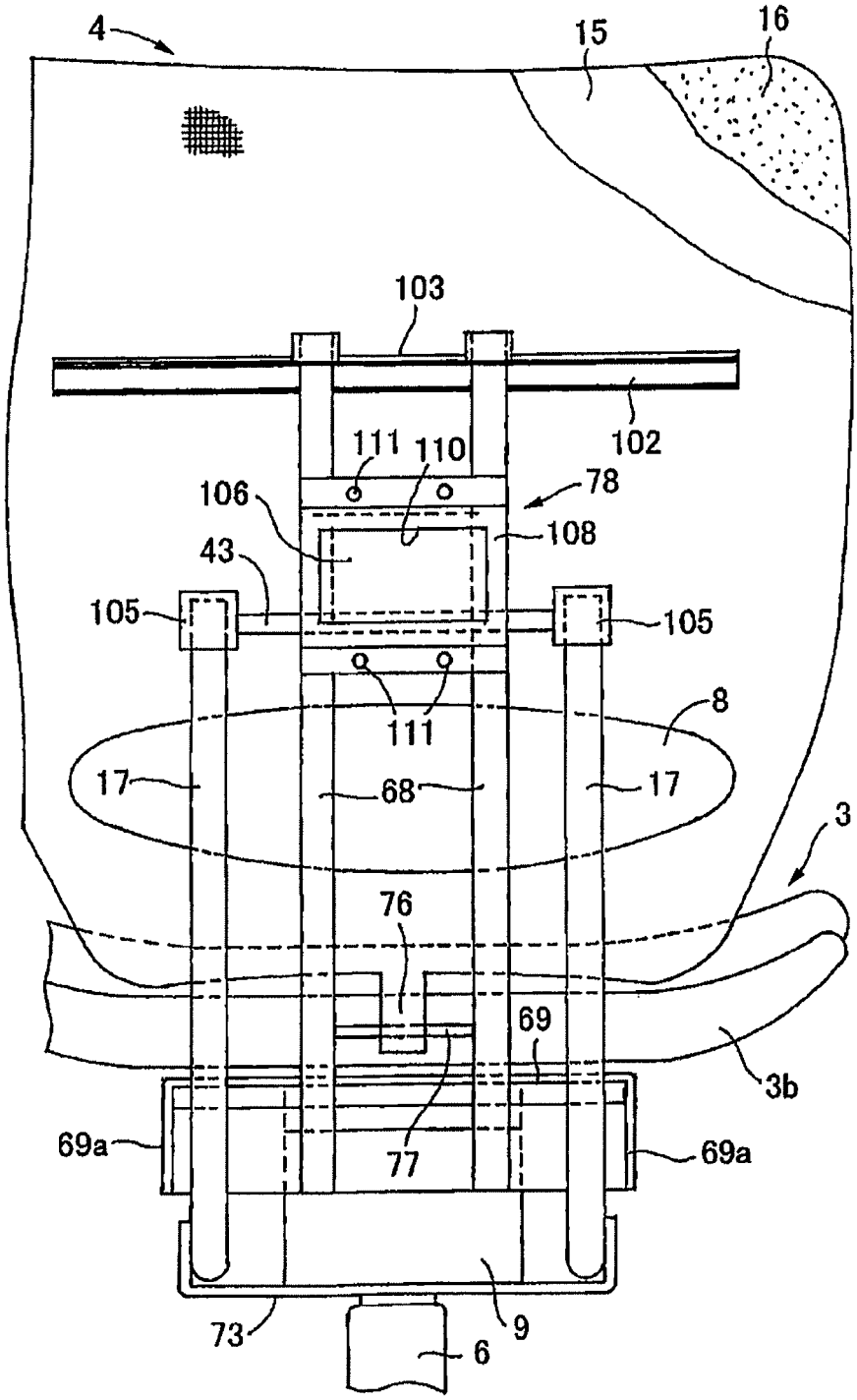
FIG. 26 is a rear view of a back section.
Figure 27:
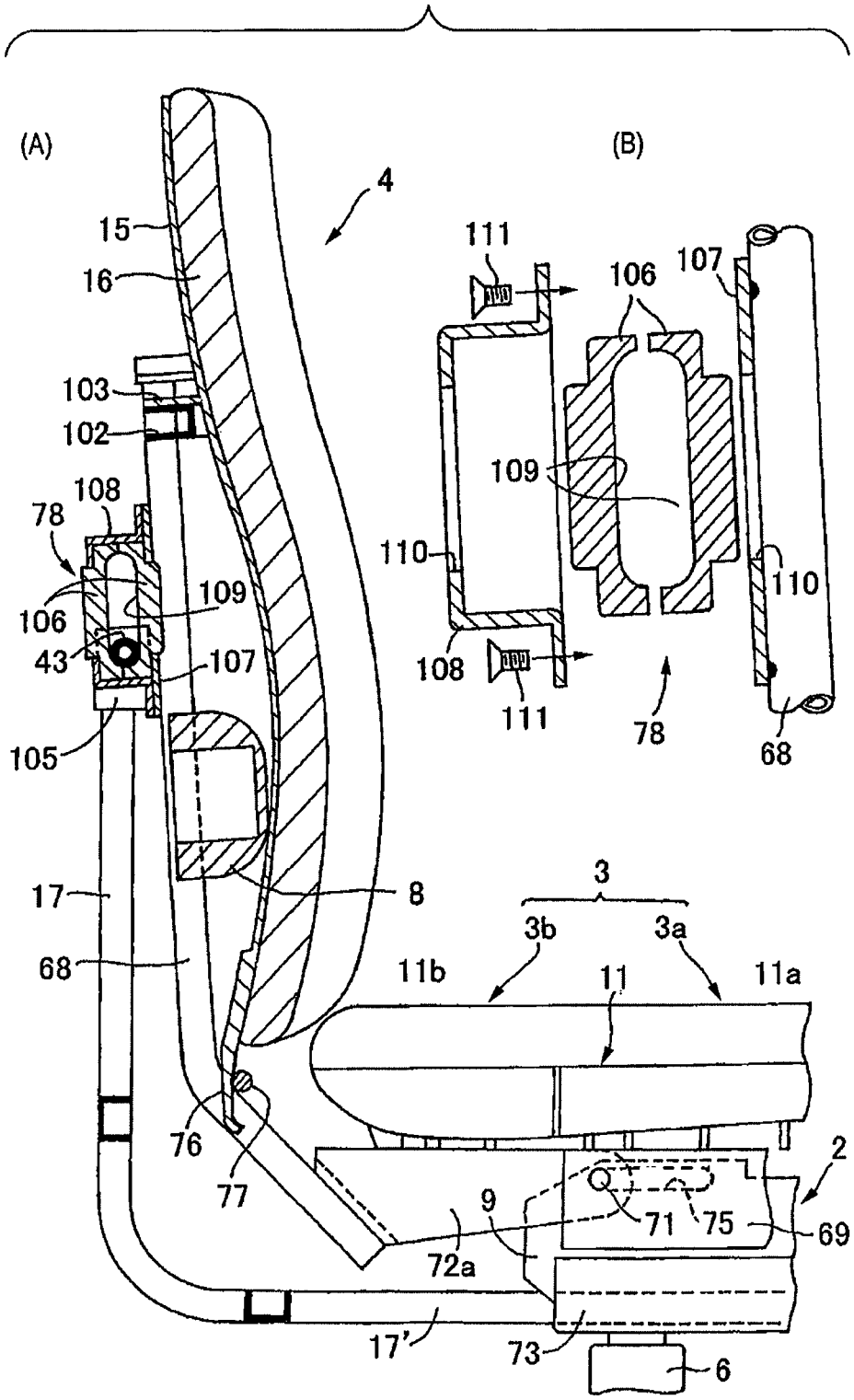
FIG. 27(A) is a longitudinal side elevation, and (B) it is a separated cross sectional view showing a principal block of backrest guide means.

The backrest 4 and a structure for attaching the backrest 4 are now described by reference to FIG. 26 and FIG. 27 as well as to the previously-described drawings. As shown in FIG. 26, the two back support 68 are provided on the right and left sides with the vertical centerline interposed therebetween. A horizontally-long upper member 102 is fixed to the upper ends of the back support 68, and the back panel 15 is affixed to the upper member 102. As shown in FIG. 27(A), back face ribs 103 that overlap the upper member 102 of the back support 68 are formed integrally on the back panel 15, whereby the back face ribs 103 are fixed to the upper member 102.

Lower portions of the right and left back support 68 remain tilted backwards. Further, a rear plate 104 (see FIG. 18) that is tilted when viewed sideways is welded to a back face of the second intermediate fixture 72. The back support 68 are welded to the rear plate 104 (see FIG. 18). A horizontally oriented stopper 77 is welded to the right and left back support 68. Although unillustrated, the right and left back support 68 are joined together by means of a reinforcement member.

The back support 17 is placed one on either side of the pair of back support 68. The horizontally-long guide pin 43 is attached to upper ends of the right and left back support 17 by way of an upper bracket 105. The upper bracket 105 can also be welded or screwed to the back support 17.

As shown in FIG. 27, the guide body 78 is made up of sliders 106 that are made of a resin and in which the guide pin 43 is sandwiched between the front and back sliders 106, a front panel 107 affixed to the back support 68, and a case 108 fitted to the respective sliders 106 from behind. Recesses 109 for allowing vertical movements relative to the guide pin 43 are formed opposite each other in mating faces of the respective sliders 106. Window apertures 110 that fit to respective projections formed on the sliders 106 are formed in the front panel 107 and the case 108, respectively. The front and back sliders 106 are fitted to the case 108 while superimposed on each other. Further, the front panel 107 and the case 108 are fastened together with screws 111 while the projections of the front and back sliders 106 remain fitted into the front panel 107 and the case 108.

(10) Summary

Figure 28:
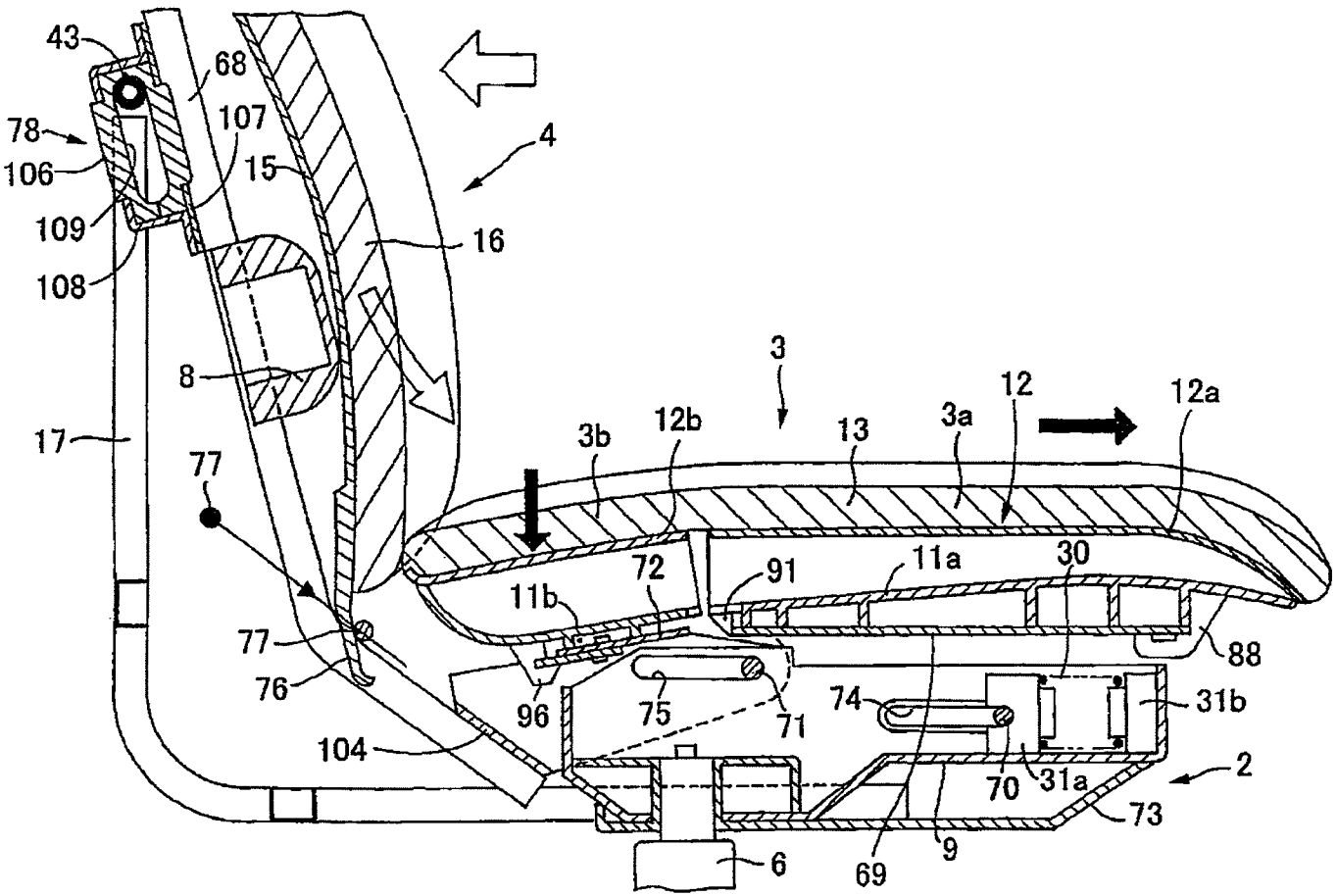
FIG. 28 is a longitudinal side elevation of the chair in a rocking state.

FIG. 28 is a longitudinal side elevation of the chair in a rocking state. As described in connection with the summary, when the seated person leans against the backrest 4, the backrest 4 tilts backwards around the second pin 71. However, the second pin 71 moves forwards, and hence the backrest 4 moves downward in its entirety while tilting backwards around a substantial intermediate point on the backrest 4 along its vertical direction. Further, the second section 3*b* tilts backwards while the entirety of the seat 3 moves forwards.

Figure 29:
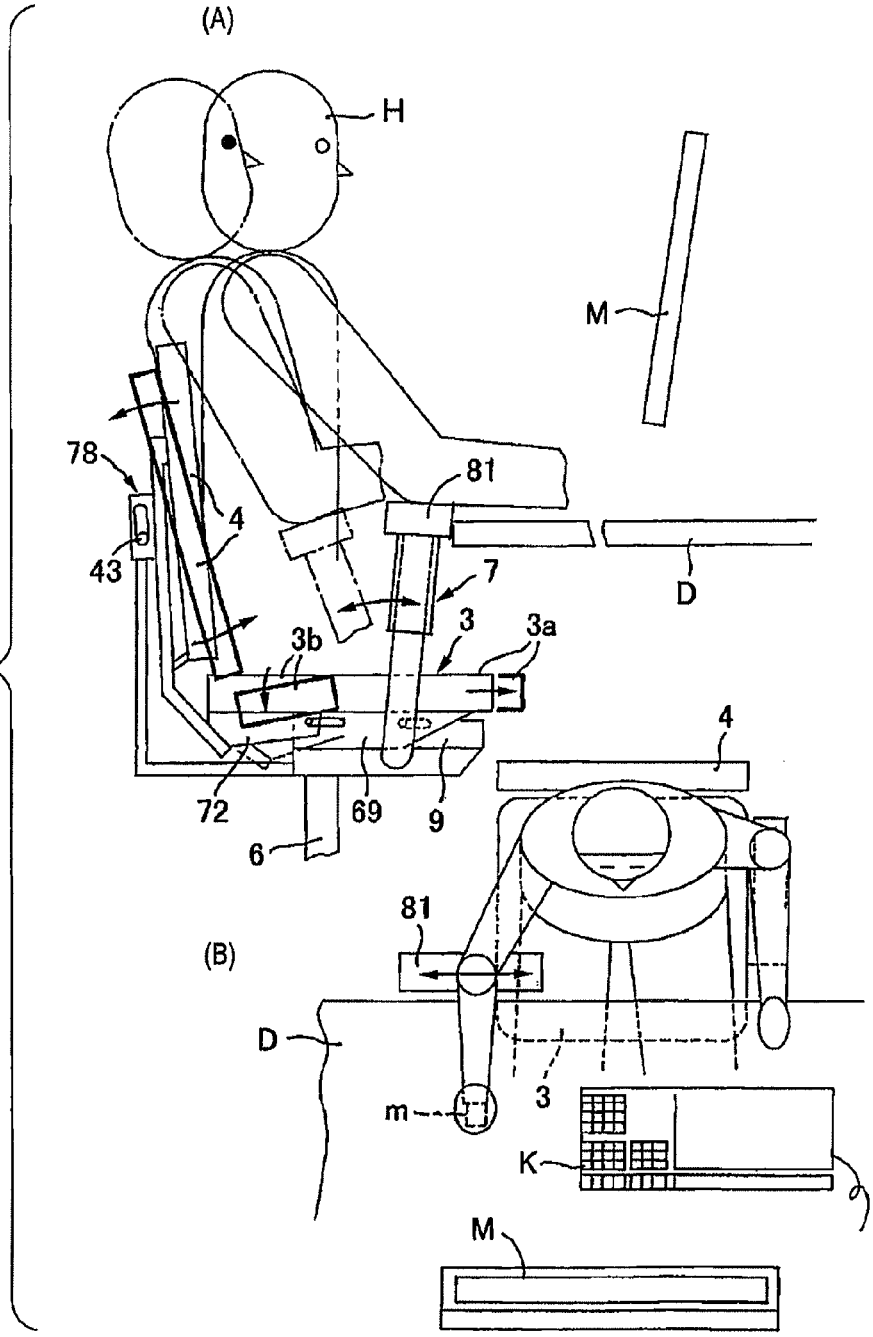
FIGS. 29 (A) and (B) are schematic side views showing a relationship between the chair and a monitor on a desk.

FIG. 29(A) is a schematic view (a side elevation) showing a relationship between the chair of the embodiment and the monitor on the desk, and FIG. 29(B) is a schematic plan view of the chair in an operating state. As a result of the seat 3 moves forwards during rocking action, a degree of satisfaction of rocking can be enhanced as much as possible. Further, since the upper body of the seated person does not much bend backwards, the person can view the monitor M on the desk from front without raising his/her head H much in the rocking state. Therefore, strains on the neck and the shoulders can be eased.

Figure 17:
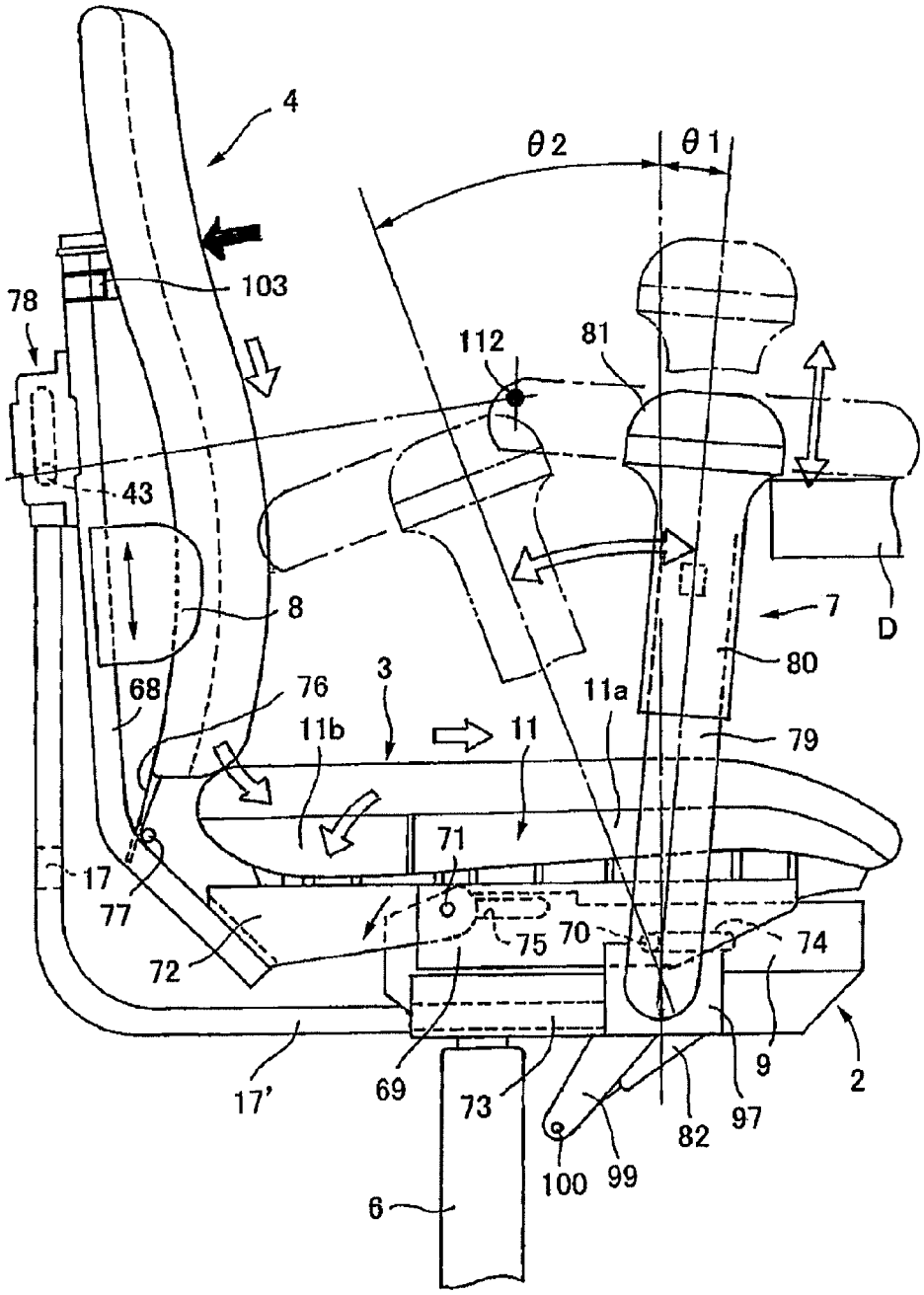
FIG. 17 is a general side view of an entirety of a chair of a second embodiment.

The backrest 4, the second intermediate fixture 72, and the back support 68 can be conceived as a single structure. Accordingly, although the backrest 4 tilts by means of guiding actions of the second long holes 75 and the guide pin 43. However, the second long holes 75 remain in a horizontal position, and the guide body 10 moves in the vertical direction. Hence, the backrest 4 assumes the same state in which the backrest 4 turns (swings) around a phantom line as if a seat swing swings. In the present embodiment, as shown in FIG. 17, a phantom center line 112 used when the backrest 4 tilts (turns or swings) is situated in the vicinity of the upper surfaces of the respective arm pads 81.

The arm pads 81 move back and forth, and the phantom center 112 itself also moves along with the tilting action of the backrest 4. In any case, the phantom center 112 is set so as to be situated between a neighborhood of the upper surfaces of the arm pads 81 achieved when the arm pads 81 have fully moved forward and a neighborhood of upper surfaces of the arm pads 81 achieved when the arm pads 81 have fully moved backward. If the seated person has a common physical constitution, the phantom pivot center 112 of the backrest 4 is situated at a neighborhood of the front surface of an abdomen (particularly around a bully button) of the seated person. Moreover, when the seat 3 is taken as a reference, a phantom center 64 is set before or after a neighborhood of an intermediate point of the seat 3 in its front-back direction such that a height from the seat surface comes to about 20 to 30 cm.

In any case, the phantom center 112 of the tilting action of the backrest 4 is situated above the seat forward of the backrest 4. As a result, even when the chair rocks, the upper body of the seated person does not move backward in its entirety. For this reason, the chair does not move away from the top plate D of the desk even in the rocking state. As a consequence, the seated person can smoothly perform operation of a mouse "m" or operation of a keyboard K while remaining in a rocking state.

(11) Others

The respective embodiments are mere examples of the present invention. In addition to being embodied in the embodiments, the present invention can also be embodied in various manner. For instance, the seat-mounting shell is not necessarily required. The seat panel; for instance, can also be attached directly to the seat-mounting fixture (the intermediate fixtures).

The second section of the seat can also be deformed in a flexural manner in such a way that the rear end of the second section descends maximum. Further, the second section can also be subjected to stepwise flexure. Alternatively, there can also be adopted a configuration in which during rocking the first section moves forwards while slightly tilting forwards or in which the first section slightly tilts backwards and the second section tilts backwards at an angle larger than the tilt angle of the first section while the entirety of the seat is moving forwards. Various means, such as a gas cylinder and rubber, can be used as spring means that imparts resistance to rocking action.

When the arm rest devices are attached to the chair, the arm rest chairs can be affixed to the second intermediate fixture of the second embodiment or to the back support described in connection with both embodiments. The seat-mounting fixture and the intermediate fixtures can also be made of resin.

INDUSTRIAL APPLICABILITY

The present invention can exhibit usefulness when embodied in the form of a chair. Accordingly, the present invention can be industrially utilized.

DESCRIPTIONS OF THE REFERENCE NUMERALS AND SYMBOLS

1 LEG UNIT
2 BASE SECTION
3 SEAT
3*a* FIRST SECTION OF SEAT
3*b* SECOND SECTION OF SEAT
4 BACKREST
5 BACK SUPPORT
9 BASE BODY
10 SEAT-MOUNTING FIXTURE
11 SEAT-MOUNTING SHELL (SEAT OUTER SHELL)
12 SEAT PANEL (SEAT INNER SHELL)
12*a* FIRST SECTION OF SEAT PANEL
12*b* SECOND SECTION OF SEAT PANEL
13 SEAT CUSHION BODY
14 BACK COVER (BACK OUTER SHELL)
11*a* MAIN BODY OF BACK COVER
11*b* FRONT FACING SECTION OF BACK COVER
15 BACK PANEL (BACK INNER SHELL)
16 BACK CUSHION BODY
17 BACK SUPPORT
18 SUPPORT COVER
25 JOINT SHAFT
30 ROCKING SPRING
40 LONG GROOVE OF BACK COVER 14
43 GUIDE PIN THAT IS ELEMENT OF BACKREST GUIDE MEANS
45 GUIDE MEMBER THAT IS ELEMENT OF BACKREST GUIDE MEANS
69 FIRST INTERMEDIATE FIXTURE
72 SECOND INTERMEDIATE FIXTURE

The invention claimed is:

1. A rocking chair, comprising:

a seat on which a person is to sit;

a backrest against which a seated person leans; and a base section that supports the seat and the backrest and that is configured in such a way that, when a seated person leans against the backrest, the seat moves forwards and the backrest tilts backwards while an upper end of the backrest moves backwards and while a lower end of the backrest moves forwards;

wherein the seat has a first section including a front end of the seat and a second section including a rear end;

the second section can tilt backwards with respect to the first section when viewed sideways;

the backrest is supported by backrest guide means so as to descend while tilting backwards;

the second section of the seat and the backrest are joined together in such a way that the second section of the seat tilts backwards when the backrest moves downward; and an entirety of the backrest descends while tilting backwards when the seated person leans against the backrest, so that the second section tilts backwards while the entirety of the seat is moving forward.

2. The rocking chair according to claim 1, wherein the backrest guide means has a back support affixed to the base section and that stands up; the backrest has a back cover; and the back cover has a downwardly-opened long groove into which the back support fit.

3. The rocking chair according to claim 2, wherein the back cover is joined to the back support so as to tilt while descending.

4. The rocking chair according to claim 2, wherein the back support is configured of a channel material.

5. The rocking chair according to claim 2, wherein the back support is configured of a metal.

6. The rocking chair according to claim 2, wherein a horizontally long guide pin is provided at upper ends of the back support as an element of the backrest guide means; and a vertically long guide groove into which the guide pin slidably fits is provided on an inner side surface of the long groove of the back cover as an element of the backrest guide means.

7. The rocking chair according to claim 2, wherein the back cover is provided with cover means for covering a guide section without regard to backward tilting of the backrest.

8. The rocking chair according to claim 2, wherein upper ends of the back support are situated at a height between an upper end and a lower end of a back panel.

9. The rocking chair according to claim 2, wherein a guide section for supporting the backrest in such a way that the back rest tilts backwards while moving downwards is provided at upper ends of the back support.

10. The rocking chair according to claim 2, wherein the first section of the seat is attached to a first intermediate fixture joined to the base section so as to be movable back and forth; the second section of the seat is attached to a second intermediate fixture joined to the first intermediate fixture so as to be tiltable in a backward direction; and the backrest is attached to the back support affixed to the second fixture.

11. The rocking chair according to claim 1, wherein a hinge section is formed in a seat panel so as to enable a bendable joint, thereby making up the first section and the second section.

12. The rocking chair according to claim 11, wherein the seat panel is divided into a first section and a second section in correspondence with the first section and the second section of the seat, and a group of slits that are long in a right-left direction of the seat panel are formed between the first section and the second section of the seat panel.

13. The rocking chair according to claim 11, wherein the base section has a housing-shaped base body and a seat-mounting fixture attached to an upper end of the base body so as to be slidable in a front-back direction; and the seat panel is attached directly to the seat-mounting fixture.

14. The rocking chair according to claim 1, wherein the seat has a seat panel made of resin and a cushion material stretched over an upper surface of the seat panel.

15. The rocking chair according to claim 1, wherein the backrest has a back panel and a cushion material stretched over a front surface of the back panel.

16. The rocking chair according to claim 12, wherein the back panel is attached to the back cover such that the back panel can be deformed under body pressure of the seated person, and the back cover and the second section of the seat are joined so as to move synchronously.

* * * * *